US010833402B2

(12) United States Patent
Khushrushahi et al.

(10) Patent No.: US 10,833,402 B2
(45) Date of Patent: Nov. 10, 2020

(54) SOFTWARE DEFINED ANTENNA USING CONTROLLABLE METAMATERIALS

(71) Applicant: Notch, Inc., Cambridge, MA (US)

(72) Inventors: Shahriar Khushrushahi, Cambridge, MA (US); Wardah Inam, Cambridge, MA (US)

(73) Assignee: Notch, Inc., Cambridge, MA (US)

( * ) Notice: Subject to any disclaimer, the term of this patent is extended or adjusted under 35 U.S.C. 154(b) by 22 days.

(21) Appl. No.: 16/277,065

(22) Filed: Feb. 15, 2019

(65) Prior Publication Data

US 2019/0260120 A1 Aug. 22, 2019

Related U.S. Application Data

(60) Provisional application No. 62/710,338, filed on Feb. 16, 2018.

(51) Int. Cl.

| | |
|---|---|
| ***H05B 33/00*** | (2006.01) |
| ***H01Q 1/52*** | (2006.01) |
| ***H01Q 1/24*** | (2006.01) |

(52) U.S. Cl.

CPC ..... *H01Q 1/523* (2013.01); *H01Q 1/241* (2013.01)

(58) Field of Classification Search

CPC ..... H04W 24/02; H04W 24/10; H04W 16/28; H04W 24/08; H04W 28/0236; H04W 28/0268; H04W 28/0284; H04W 28/24; H04W 40/22; H04W 48/06; H04W 4/50; H04W 72/042; H04W 72/085; H04W 84/02; H04W 84/045; H04W 88/04; H04W 88/08; H04W 24/04; H01Q 1/02; H01Q 1/1207; H01Q 1/1228; H01Q 1/1257; H01Q 1/246; H01Q 1/36; H01Q 1/42; H01Q 1/50; H01Q 21/00; H01Q 21/065; H01Q 21/08; H01Q 21/205; H01Q 21/24; H01Q 21/28; H01Q 25/002; H01Q 25/005; H01Q 3/02; H01Q 3/04; H01Q 3/10; H01Q 3/12; H01Q 3/24; H01Q 3/26; H01Q 3/2611; H01Q 3/36

See application file for complete search history.

(56) References Cited

U.S. PATENT DOCUMENTS

| | | |
|---|---|---|
| 4,672,378 A | 6/1987 | Drabowitch et al. |
| 7,679,563 B2 | 3/2010 | Werner et al. |

(Continued)

OTHER PUBLICATIONS

International Searching Authority/US—International Search Report and the Written Opinion, International Application No. PCT/US2019/018197, 16 pages, dated May 1, 2019.

*Primary Examiner* — Monica C King

(74) *Attorney, Agent, or Firm* — Sunstein LLP

(57) ABSTRACT

A reconfigurable antenna system includes an antenna array; a set of metamaterial panels configured to surround the antenna array; a control unit, coupled to each of the metamaterial panels, for selectively addressing each of the metamaterial panels to control separately at least one property of each of the metamaterial panels; and a receiver coupled to the antenna array and to the control unit. The control unit is configured to monitor signal reception by the antenna array via the receiver and to establish a set of configurations of the metamaterial panels to produce a pattern of reception according to a set of prespecified criteria that include a set of azimuthal and elevational ranges characterizing the configurations. Optionally, the system further includes a transmitter coupled to the antenna array and to the control unit.

20 Claims, 21 Drawing Sheets

(56) References Cited

U.S. PATENT DOCUMENTS

| | | | |
|---|---|---|---|
| 9,450,304 | B1 | 9/2016 | Edalati et al. |
| 9,800,444 | B2 | 10/2017 | Moon et al. |
| 2015/0280957 | A1 | 10/2015 | Lim et al. |

* - If TX is enabled. If TX not enabled then in receiver mode

* - If TX is enabled. If TX not enabled then in receiver mode

SOFTWARE DEFINED ANTENNA USING CONTROLLABLE METAMATERIALS

RELATED APPLICATION

This application claims the benefit of U.S. application Ser. No. 62/710,338, filed Feb. 16, 2018, entitled "Reconfigurable Antenna System Having Adjustable Azimuthal and Elevational Ranges," and having the same inventors as the inventors herein. That related application is hereby incorporated herein in the entirety.

TECHNICAL FIELD

The present invention relates to antennas, and more particularly to electronically reconfigurable antennas that can convert an omnidirectional antenna pattern to a steerable directional pattern for the purposes of boosting communication range, jamming protection or controlling the side lobes and main lobes of a directional antenna without the need for mechanical actuation or multiple antenna elements.

BACKGROUND ART

As is known in this art, beam-forming capabilities for antennas are highly desirable as they lead to increased gain in the desired direction, resulting in increased communication ranges and decreased interference from other directions. Adding beam-steering allows for the ability to move these beams to communicate in multiple directions.

Directional beam-steering can be achieved by using multi-antenna arrays or mechanical steering. In a multi-antenna array, the steering of the radiation pattern can be achieved by changing the amplitude and phase of the signal output of different antenna elements of the array. These arrays require a complicated architecture of electronics and control increasing cost. In a mechanically steered antenna, moving or fixed dish reflectors are used to direct antenna radiation in a desired direction. Although simple to design, these mechanically steered antennas are limited in their applications due to their large size and high cost.

The use of electronically controlled surfaces to shape and steer the beam has been proposed as an alternative to multi-antenna array or mechanical steering. However, these are very limited in their designs and do not provide the required functionality of a fully steerable antenna system.

U.S. Pat. No. 9,450,304 discloses an embodiment of an electronically controlled beam-switching antenna. It uses 6 frequency selective surfaces surrounding a dipole to switch the antenna beam in 6 directions in the azimuthal plane.

U.S. Pat. No. 8,514,142 discloses a reconfigurable antenna utilizing a reflective screen which can be controlled by integrated switches. This screen is cylindrical in shape and is used to steer the beam 360 degrees in the azimuthal plane.

U.S. Pat. No. 6,870,517 relates to a reconfigurable antenna formed by configuring a switched plasma, semiconductor or optical crystal screen to surround a central antenna. This configuration is also extended for multiple antennas and frequencies.

There are academic papers that propose frequency selective surfaces arranged in a cylindrical shape providing beam switching and steering. This work focuses on steering in the azimuthal direction. For example, in "Smart Cylindrical Dome Antenna Based on Active Frequency Selective Surface" the authors propose a cylindrical dome antenna which is made of active frequency selective surface columns providing 360 degrees steerability of the beam in the azimuth plane. Also, a genetic algorithm is used to compensate for the mutual coupling between the columns. This work is an extension of the antenna presented in the paper "Electronically Radiation Pattern Steerable Antennas Using Active Frequency Selective Surfaces" which is similarly limited in steering.

SUMMARY OF THE EMBODIMENTS

In one embodiment, the invention provides a reconfigurable antenna system. The antenna system includes an antenna array; a set of metamaterial panels configured to surround the antenna array; a control unit, coupled to each of the metamaterial panels, for selectively addressing each of the metamaterial panels to control separately at least one property of each of the metamaterial panels; and a receiver coupled to the antenna array and to the control unit. The control unit is configured to monitor signal reception by the antenna array via the receiver and to establish a first set of configurations of the metamaterial panels to produce a pattern of reception according to a first set of prespecified criteria that include a set of azimuthal and elevational ranges characterizing the configurations.

Optionally, the system further includes a transmitter coupled to the antenna array and to the control unit. The control unit is further configured to establish a second set of configurations to produce a radiation pattern according to a second set of prespecified criteria.

Optionally, the first set of prespecified criteria establishes a reception pattern, having a beam shape, to improve reception of the signal from an external antenna array of interest. Also optionally, the second set of prespecified criteria establishes a radiation pattern, having a beam shape, to improve transmission of the signal to an external antenna array of interest.

Optionally, in the presence of a jamming signal attack, the control unit is configured to modify the first set of prespecified criteria to establish a pattern of reflection or absorption using at least one of the metamaterial panels, in the set of metamaterial panels, to attenuate the jamming signal.

Also optionally, the control unit is configured to modify the first set of prespecified criteria to establish a lobe of reception that is swept over first and second angular spans of azimuthal and elevational coordinates respectively. In a further related embodiment, the control unit is configured to correlate output of the receiver as a function of angular orientation of the lobe of reception and to associate, with a direction of an incoming signal, the angular orientation of the lobe at which the receiver output is at a maximum.

Optionally, the control unit is configured to modify the first set of prespecified criteria to establish a pattern of reception that minimizes latency, of a received signal, attributable to multipath.

Also optionally, the set of metamaterial panels is configured to become reflective in the presence of electromagnetic wave energy that exceeds a threshold level.

As a further option, the control unit is configured to independently control side lobes of reception. In another option, wherein the control unit is configured to independently control side lobes of reception and transmission. In yet another option, the control unit is configured to modulate, over time, a set of properties of the metamaterial panels to establish, for purposes of security, a modulated pattern of transmission that can be received only via a correspondingly configured antenna system.

Optionally, the set of metamaterial panels is configured to enclose the antenna array. As a further option, the set of metamaterial panels is configured to conform to a shape of the antenna array and associated electronics.

Optionally, the at least one property is selected from the group consisting of transmissivity, reflectivity, absorption, phase, polarization, bandwidth, angle sensitivity, and resonant frequency.

Also optionally, the first set of prespecified criteria includes a beam shape configured to improve reception of wireless power from an external antenna array of interest. Also optionally, the second set of prespecified criteria includes a beam shape configured to improve wireless power transmission to an external antenna array of interest.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Figure 1:
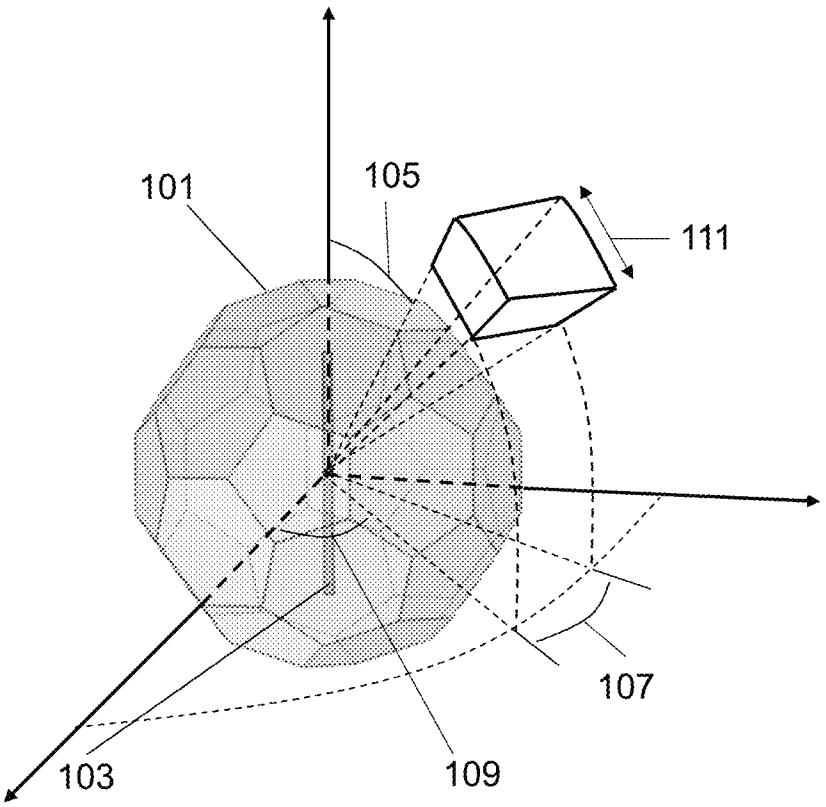
FIG. 1 is a simplified embodiment of the present invention, showing an antenna array enclosure made of metamaterial panels in the form of active metamaterial panels that can provide 360-degree beam steering in both the azimuthal plane and the elevational plane.

Definitions. As used in this description and the accompanying claims, the following terms shall have the meanings indicated, unless the context otherwise requires:

A "set" includes at least one member.

An "antenna array" is a set of interconnected antenna elements that can generate an isotropic, omnidirectional or even directional radiation pattern.

To "surround" an antenna array with a set of metamaterial panels means to physically arrange the set of metamaterial panels so that when the set of metamaterial panels are addressed the set can be configured to modify a pattern of radiation or reception associated with the antenna array, regardless whether the antenna array is fully enclosed by the set of metamaterial panels.

"Frequency band" is a continuous uninterrupted frequency range, that the metamaterial is tuned for, spanning from a minimum frequency to a maximum frequency.

"Resonant frequency band" is a frequency band or multi-band for which the metamaterial is tuned.

"Bandwidth" of a metamaterial is the range of a frequency band, for which the metamaterial is tuned, and is the difference between the maximum and minimum frequency in the frequency band.

A "center frequency" of a metamaterial is a single frequency that is in the center of the resonant frequency band for which the metamaterial is tuned.

"Multi-band" of a metamaterial is a set of frequency bands centered at different center frequencies with different bandwidths.

A "passive" control is control achieved without the continuous application of power, although power may be applied initially in changing a geometric or other configuration.

An "active" control is control achieved through the sustained application of power over time.

"Mechanical control" of a metamaterial is control, achieved using any mechanically based technology, of a property of the metamaterial by causing a physical change in a dimension, location or orientation of any component of the metamaterial. "Mechanical control" includes control achieved by a magnetic, electric, or electromagnetic force to effectuate such a change, including by use of a shape-memory alloy, a tunable material, or a mechanical actuator.

"Magnetic control" of a metamaterial is control, achieved using any magnetic based technology, of a property of the metamaterial or any component thereof, including through the use of any magnetic component such as a ferrite, a permanent magnet, or an electromagnet.

"Electrical control" or "electronic control" of a metamaterial is control, achieved using any electrical (i.e., high voltage) or electronic (i.e., low voltage) technology, of a property of the metamaterial or any component thereof, including through the use of static electricity or plasma or the addition of a PIN diode, a PN diode, a varactor diode, a transistor, or a lumped element such as a capacitor, inductor, resistor or other non-linear or linear switching element, and combinations thereof.

A "metamaterial" is an engineered material having frequency selective behavior in a member selected from the group consisting of a surface, a volume, and combinations thereof, by virtue of a set of repeated patterns of conductive elements in the material. The metamaterial's frequency selective behavior is tuned at a resonant frequency such that a wave impinging on the metamaterial experiences properties of the material including transmissivity, reflectivity, absorption, phase shift, polarization change, bandwidth change and change in angle sensitivity. These properties of the metamaterial, including the tuned resonant frequency, can be modified by mechanical control, magnetic control, electrical control or electronic control and combinations thereof; these forms of control may be active or passive.

To "control a property of the metamaterial" is to control one or more parameters associated with the metamaterial in connection with a wave impinging thereon, such as transmissivity, reflectivity, absorption, phase, polarization, bandwidth, angle sensitivity and resonant frequency. The control may be active or passive, and may be applied with respect to a wave that is transmitted or reflected or both transmitted and reflected.

A "panel" is an active or passive metamaterial that is made up of electronically addressable individual subpanels.

A "subpanel" is an active or passive metamaterial that forms a subset or building block of a "panel" that can be individually controlled.

An "FSL" is a Frequency Selective Limiter, which is a metamaterial limits the power of an electromagnetic signal of a frequency band.

An "enclosure" is used to describe a set of active or passive metamaterial panels or a combination of both, that are used to partially or completely enclose an antenna.

FIG. 1 is a simplified embodiment of the present invention, showing an antenna array enclosure 101 made of active metamaterial panels that can provide 360-degree beam steering in both the azimuthal plane and the elevational plane. In this embodiment, the enclosure 101 is spheroidal, although any shape of enclosure that is sufficient to surround, completely or partially, the antenna array may be satisfactory; in various embodiments, the enclosure is shaped to conform to the shape of the array and associated electronics. The enclosure 101 surrounds antenna 103, which may be a single antenna of any sort or a multi-antenna array. For all subsequent figures herein, the antenna 103 will represent any type of single, directional, omnidirectional or multi-antenna array. The enclosure 101 that completely or partially surrounds the antenna 103 is made up of N faces or panels that can be individually addressed electronically (using a processor/controller or a similar device with appropriate control lines). In the diagram shown, a truncated icosahedron (a soccer ball shape) is shown to enclose the antenna, but the actual embodiment can be any combination of N panels surrounding the antenna. The panels themselves are active metamaterial panels that can change behavior from a band-pass to band-reject filter when actuated or vice-versa. This filter-characteristic is not limited to band-pass/reject but can encompass all other types of filters (high-pass, low-pass, all pass, no pass etc.). Accordingly, embodiments of the present invention can provide directional protection against any intentional or unintentional interference while allowing for desired signals to be directionally passed through to the antenna. The directional protection spans an azimuthal range 107 and an elevational range 111 with the azimuthal and elevational angles defined as 109 and 105 respectively. In addition, to directional jamming protection, this same behavior can also be used to boost signals. The panels can also be made of active metamaterials configured as frequency selective power limiters to limit the power incident on the surface from outside or inside the enclosure, also aiding jamming protection without the need for active control.

Figure 2:
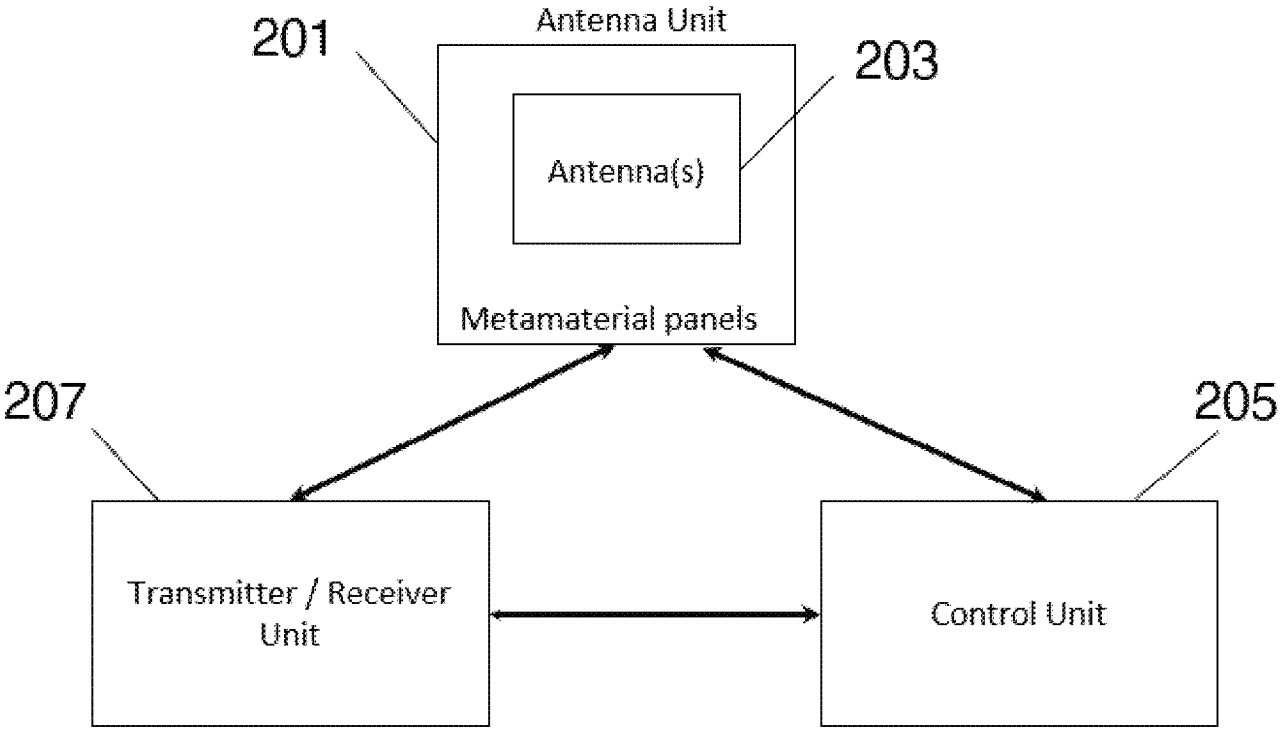
FIG. 2 is a diagram showing the basic functional units of a reconfigurable antenna system in accordance with an embodiment of the present invention.

FIG. 2 is a diagram showing the basic functional units of a reconfigurable antenna system in accordance with an embodiment of the present invention. The antenna system is composed of three units: the antenna unit, transmitter/receiver unit and the control unit. The antenna unit comprises metamaterial panels in enclosure 201 and the antenna 203. The antenna unit connects to the transmitter or receiver unit 207. The desired radiation pattern is achieved by making each of the metamaterial panels transmissive or reflective using the control unit 205 with the help of software algorithms for functionality.

Figure 3:
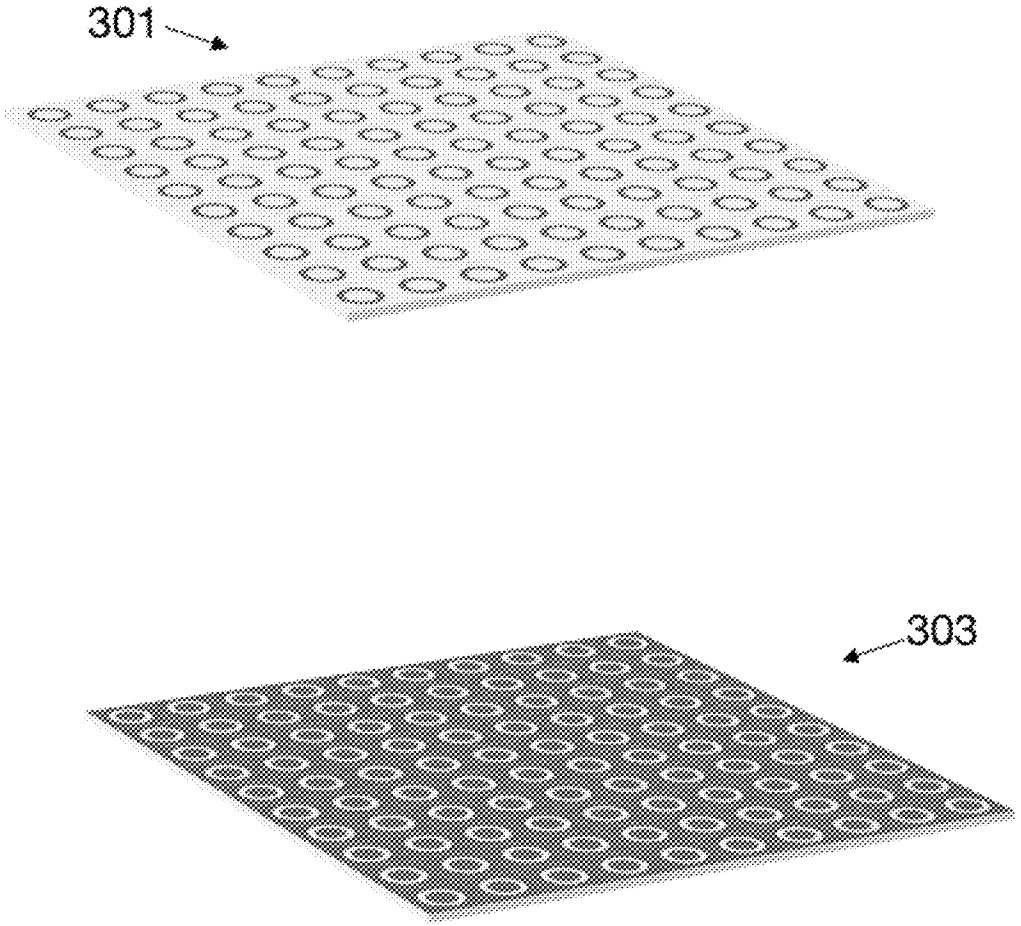
FIG. 3 is a diagram illustrating a 2D metamaterial commonly known as a Frequency Selective Surface and its complementary form.

FIG. 3 is a diagram illustrating a 2D metamaterial commonly known as a Frequency Selective Surface and its complementary form. An FSS is a periodic pattern of conductive (metal, metalized ink, plasma etc.) shapes on a substrate (printed circuit board, paper etc.) that can be made of elemental shapes or combinations of shapes. The FSS surface, shown in FIG. 3, has a repeating pattern 301 of circular rings that are conductive. In an FSS of embodiment 303 of FIG. 3, there is employed a structure that is complementary to the structure 301 of FIG. 3, in which the rings are apertures and the conductive medium is everything other than the rings.

Figure 4:
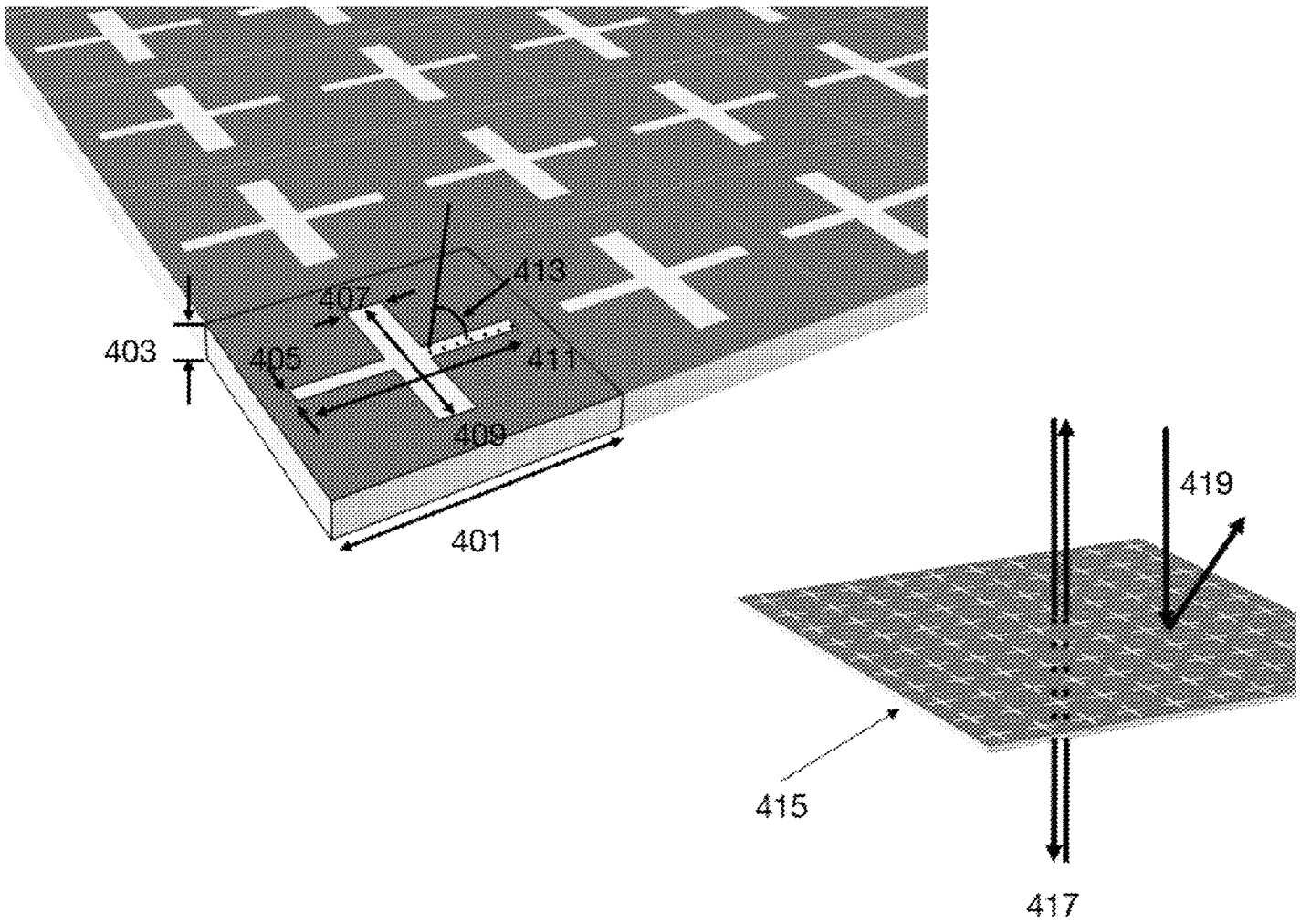
FIG. 4 is an example of a 2D metamaterial commonly known as a Frequency Selective Surface made of a cross element apertures and the different tunable dimensions which can change the resonant frequency band and filter characteristics.

FIG. 4 is an example of a 2D metamaterial commonly known as a Frequency Selective Surface made of a cross element apertures and the different tunable dimensions which can change the resonant frequency band and filter characteristics. Although a cross element aperture is illustrated here, the elements used in frequency selective surfaces for embodiments of the present invention are not limited to cross shapes. The geometry of the cross shaped element has many degrees of freedom allowing the adjustment of resonant frequency, bandpass, and other filter characteristics, including period 401 of the pattern, thickness of substrate 403, width 405, 407 and length 409, 411 of the cross elements as well as the alignment of the entire FSS surface with the impinging signal 413. Tuning these dimensions changes the filter characteristic of the surface 415, rejecting and reflecting impinged signals 419 while allowing in-band signals 417 to pass through.

Figure 5:
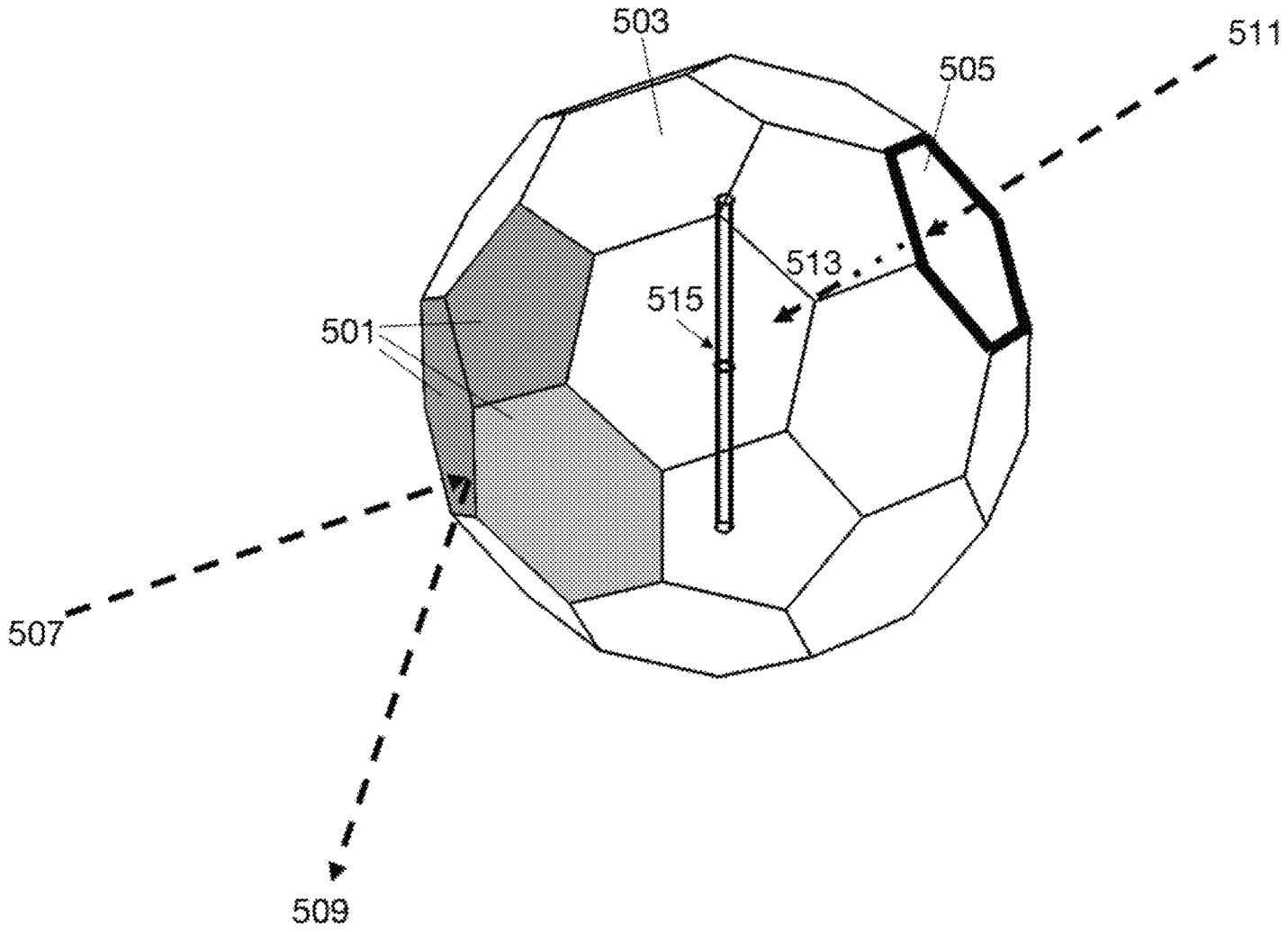
FIG. 5 is an enclosure made up of individually addressable metamaterials to protect against a jamming attack from a distinct direction in accordance with an embodiment of the present invention.

FIG. 5 is an enclosure made up of individually addressable metamaterials to protect against a jamming attack from a distinct direction in accordance with an embodiment of the present invention. The panels 501 can be activated such that they behave as reflectors. An incoming signal 507 from the direction shown is reflected by the surfaces 501 to produce reflecting signal 509 , so the incoming signal never reaches the antenna 515. The other panels 503 shown here are transmissive, allowing for incoming signals from any direction. The signal 511 incident on the surface 505 is transmitted right through the surface 505 and on internal path 513 so as to be received by the antenna 515.

Figure 6:
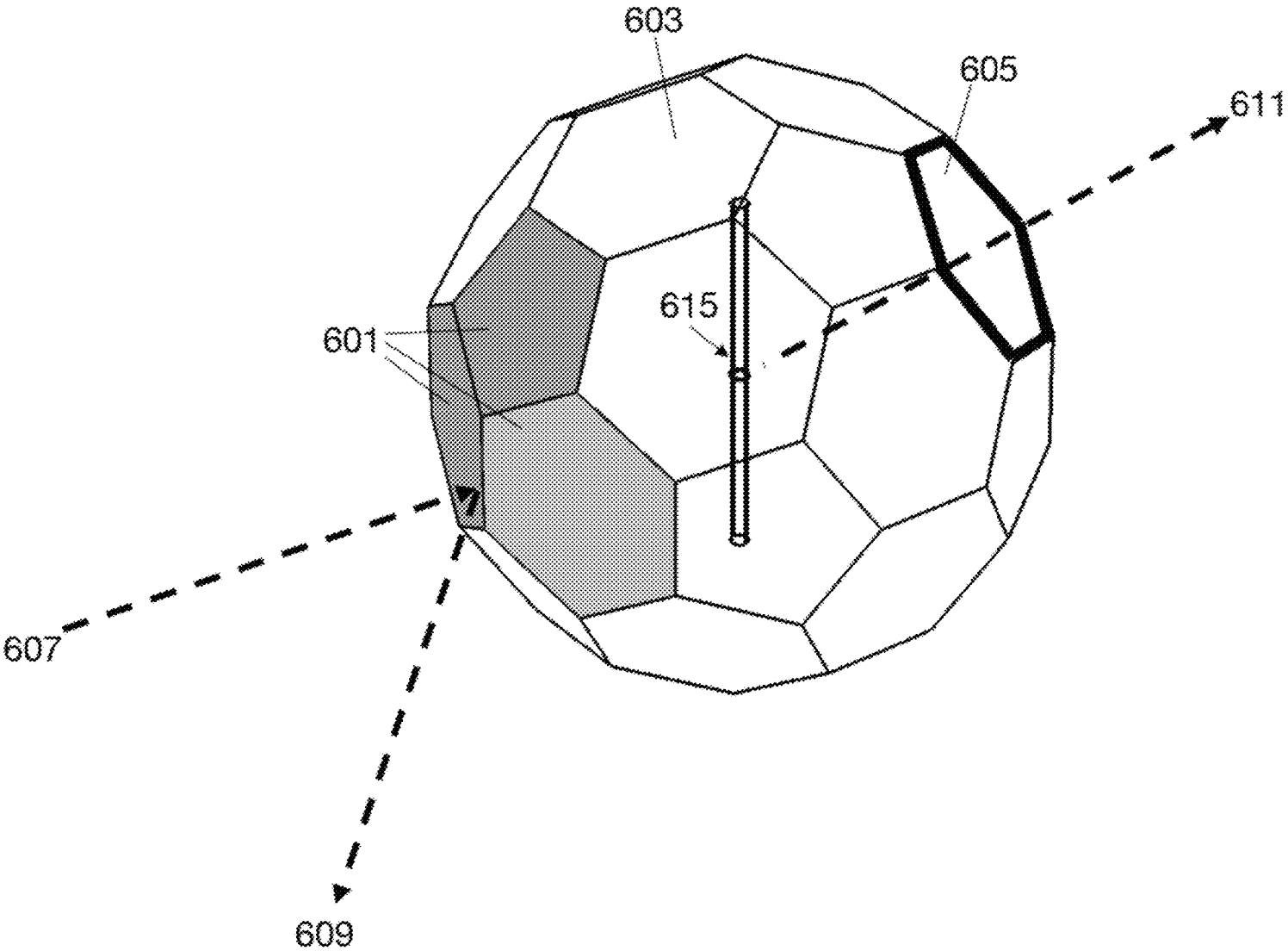
FIG. 6 is an enclosure also made up of individually addressable metamaterials to boost signal strength and communication range in a desired direction, in accordance with an embodiment of the present invention.

FIG. 6 is an enclosure also made up of individually addressable metamaterials to boost signal strength and communication range in a desired direction, in accordance with an embodiment of the present invention. The incoming signal 607 from the direction shown is reflected by the activated surfaces 601 to produce reflected signal 609 and so the incoming signal 607 never reaches the antenna 615. This same reflecting nature of the activated surfaces 601 can be used to reflect the signals emanating from the antenna 615 on the inside of the enclosure, boosting the signal power in the direction of 611, increasing the communication range in that direction. The unshaded panels, such as panels 603 and 605, are all actuated to be transmissive, allowing for the signal emanating from the antenna to transmit through the enclosure surface.

Figure 7:
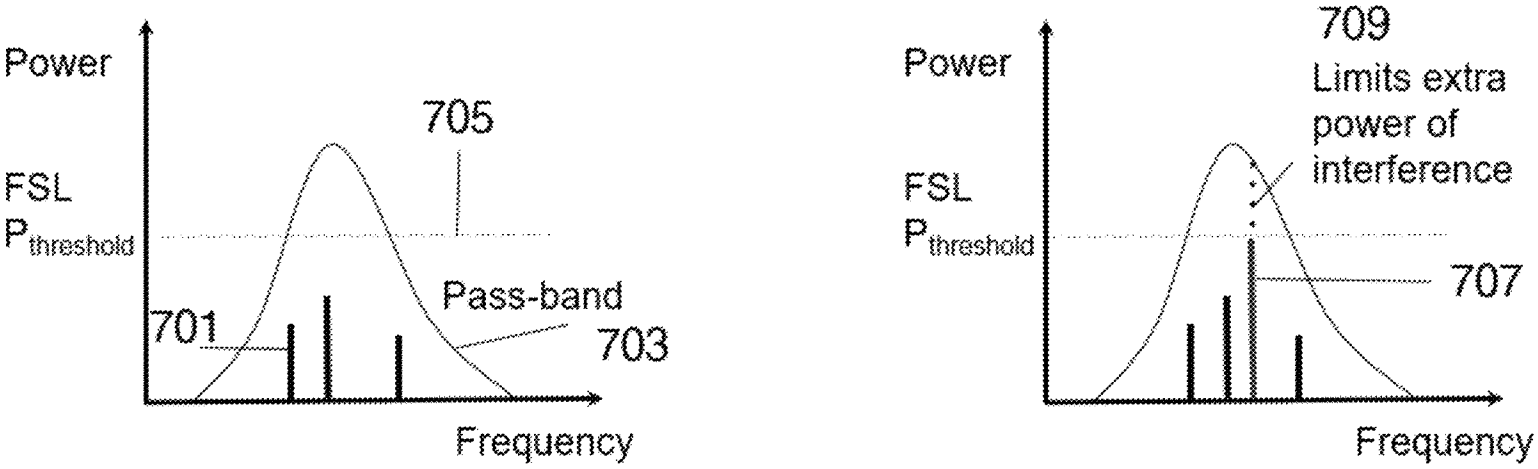
FIG. 7 are power spectrum plots illustrating the function of a frequency selective limiter in accordance with an embodiment of the present invention.

FIG. 7 are power spectrum plots illustrating the function of a frequency selective limiter in accordance with an embodiment of the present invention. Electromagnetic signals with frequencies indicated by bars 701 that are in the passband 703 of the FSL can pass through, while signals 709 above the threshold power of the FSL are power limited, as shown by bar 707.

Figure 8:
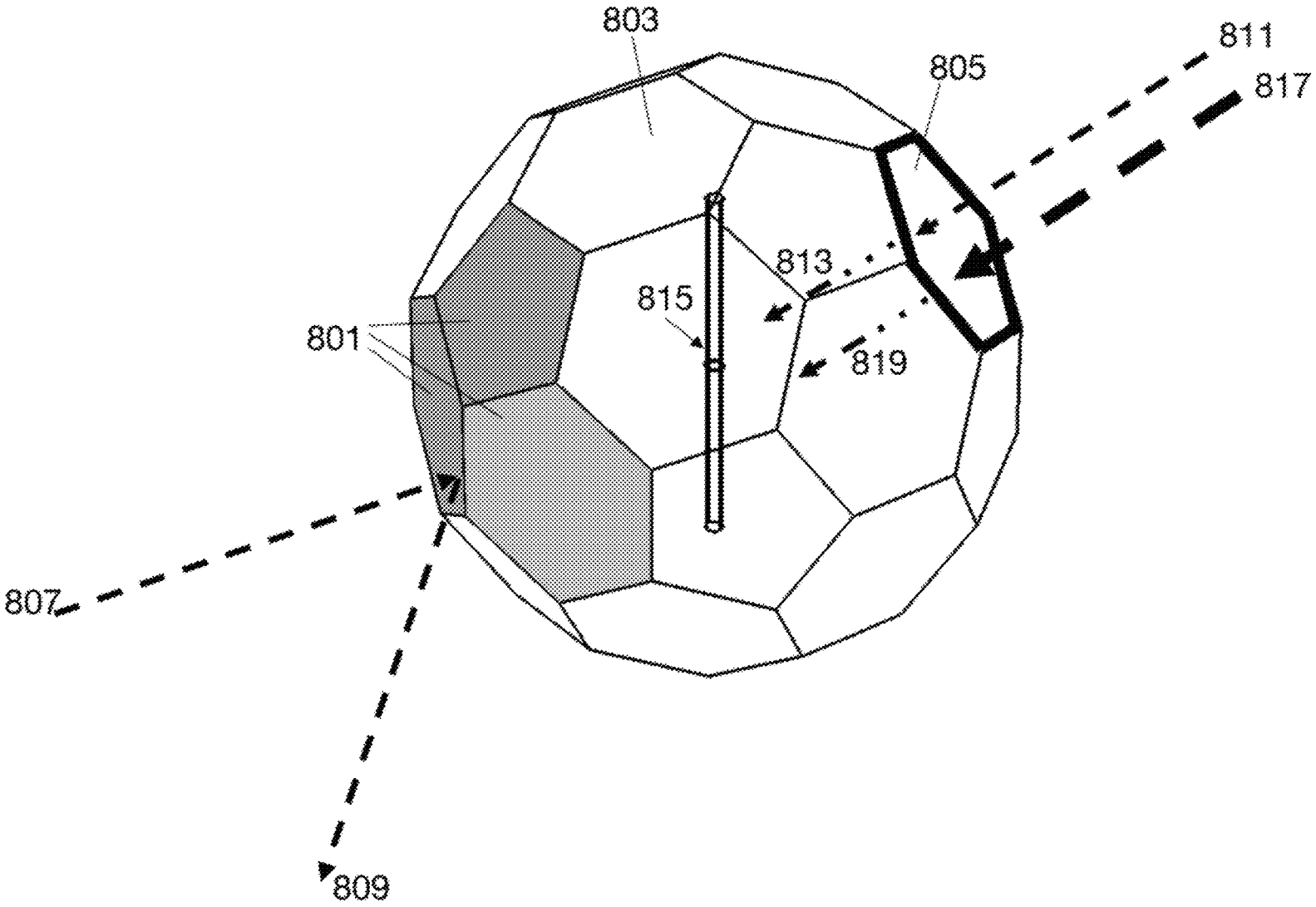
FIG. 8 is an enclosure comprising of individual panels of the metamaterial designed to act as Frequency Selective Limiters, in accordance with an embodiment of the present invention.

FIG. 8 is an enclosure comprising individual panels of the metamaterial designed to act as Frequency Selective Limiters, in accordance with an embodiment of the present invention. In this embodiment, the enclosure is made of Active Frequency Selective Surface elements with control lines. This embodiment protects against an undesired directional jamming signal 807 by activating surfaces 801 to act as reflectors to as to produce reflected signal 809. Other surfaces 803 can be made completely or partially transmissive. Desired signals 811 below or equal to a certain power level can easily transmit through the enclosure with no or little loss of power along internal path 813 before reaching the antenna. High power jamming signals 817 that are in the same direction as the desired signal 811 are automatically power limited if the panel is made up of frequency selective surfaces configured in a way to act as frequency selective power limiters, limiting the jamming signal 817 to a limited power signal 819 inside the enclosure to be received by the antenna 815.

Figure 9:
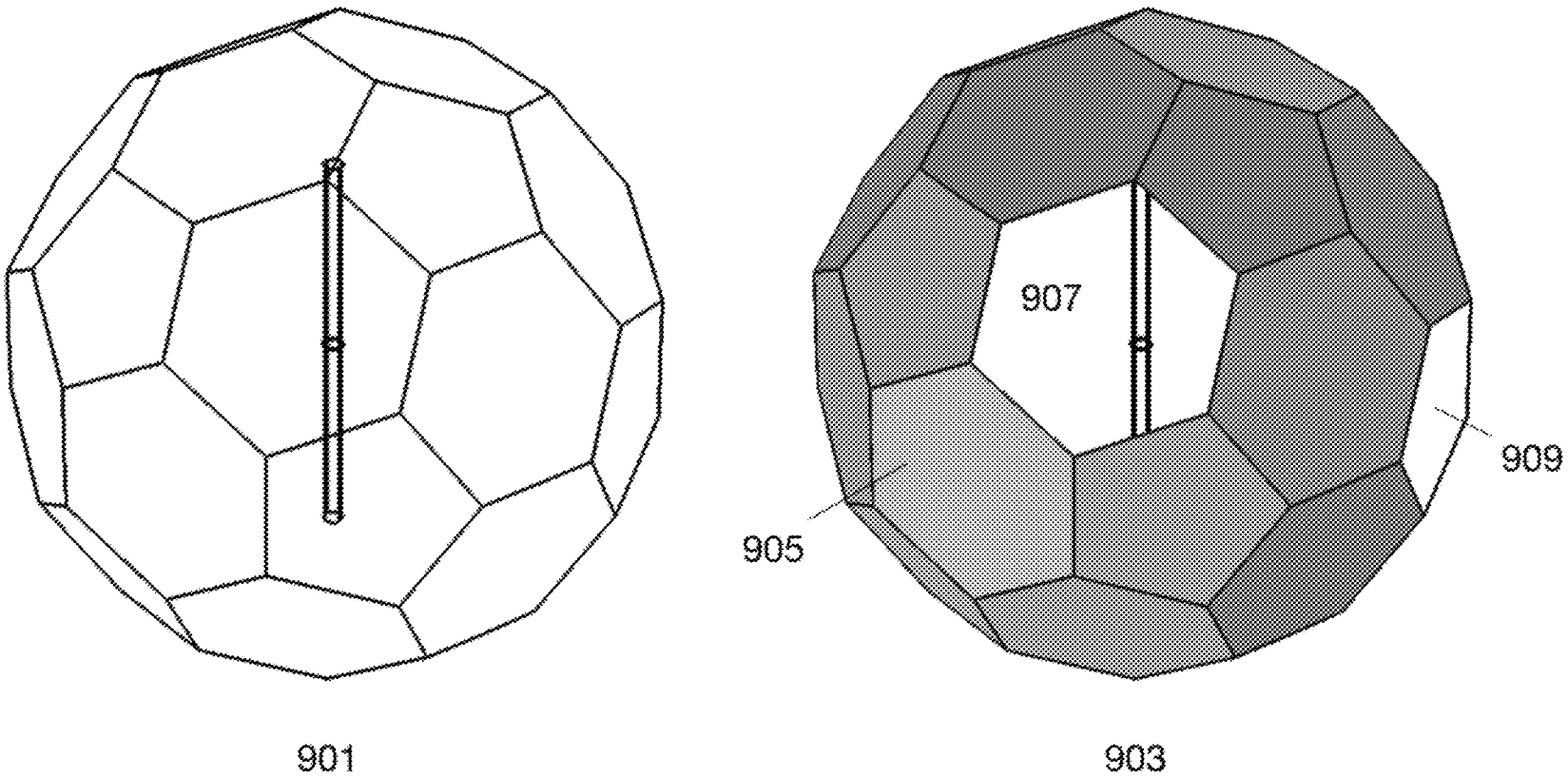
FIG. 9 is an embodiment of this invention illustrating a secure point-to-point communication link between two or more nodes, in accordance with an embodiment of the present invention.

FIG. 9 is an embodiment of this invention illustrating a secure point-to-point communication link between two or more nodes, in accordance with an embodiment of the present invention. On the left side of the figure is an enclosure 901 that is initially configured to have an omnidirectional radiation pattern. On the right side, the enclosure has been reconfigured so that some panels 905 (with dark shading) are made into reflectors while other panels 907, 909 (without shading) are maintained as transmissive, so that communication can be maintained as needed in one or more directions (two directions in this case).

Figure 10:
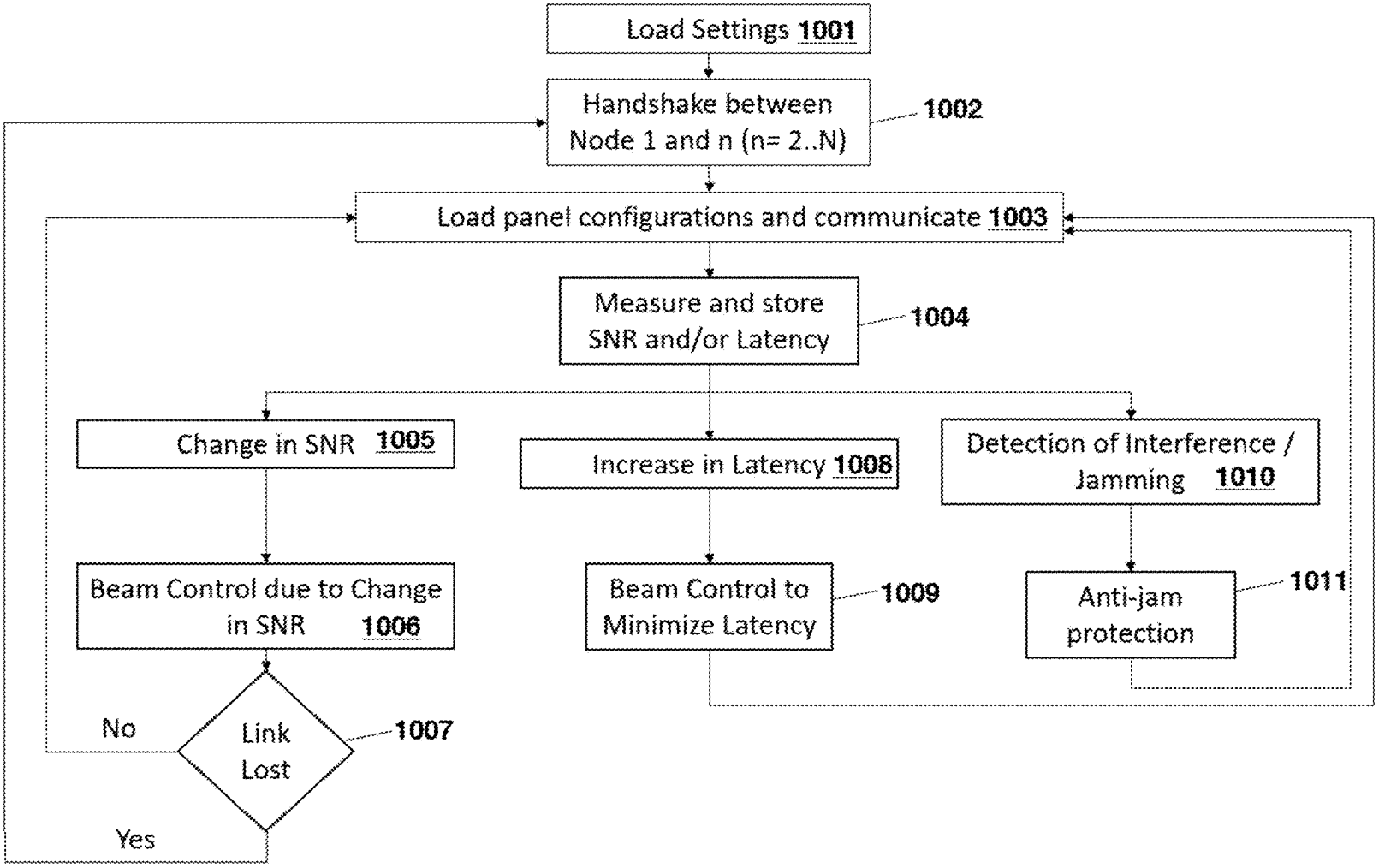
FIG. 10 is a flowchart illustrating the control system of a reconfigurable antenna in accordance with an embodiment of the present invention.
Figure 14:
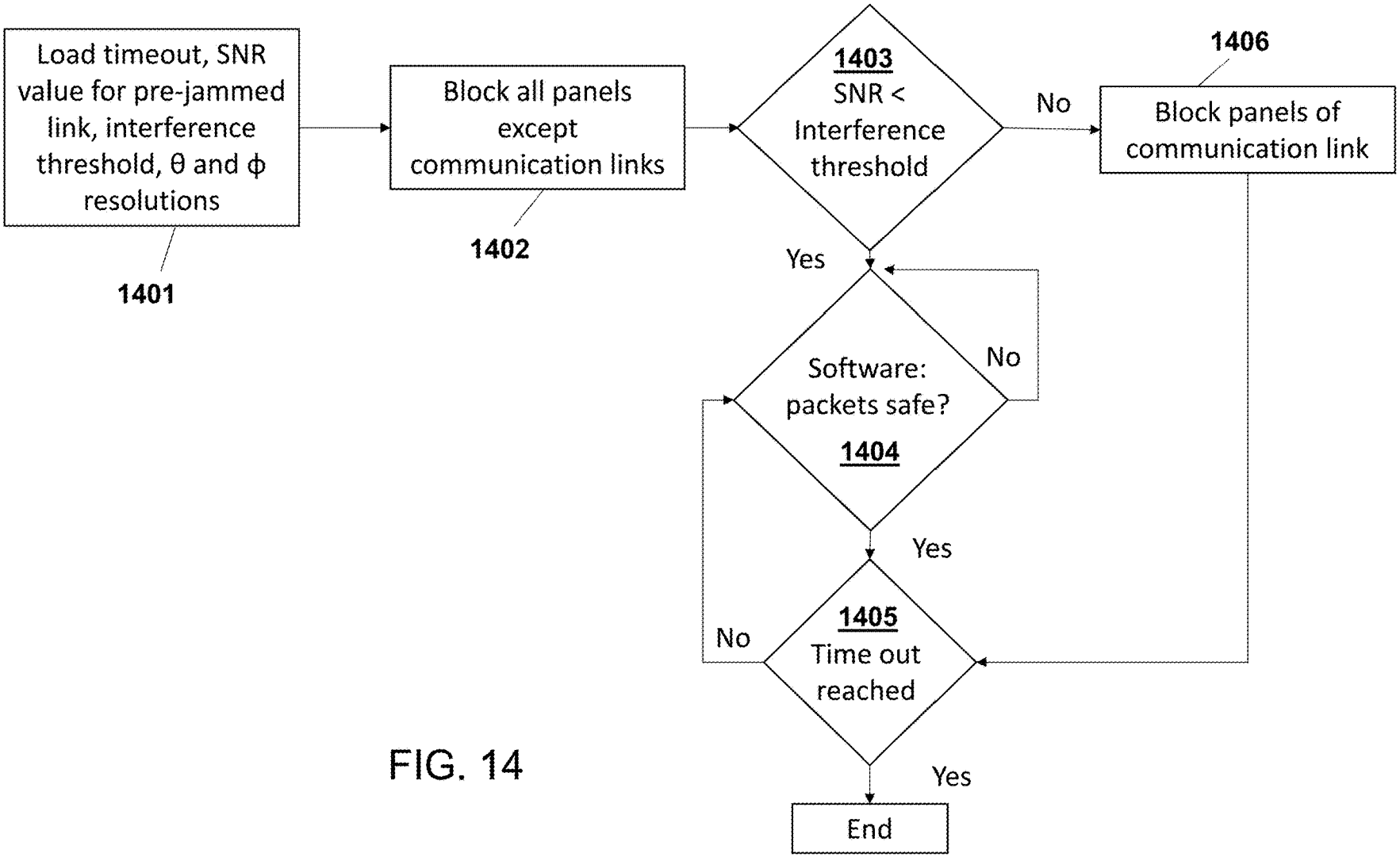
FIG. 14 is a flowchart illustrating the "Anti-Jam Protection" algorithm used in the system block diagram of FIG. 10.
Figure 17:
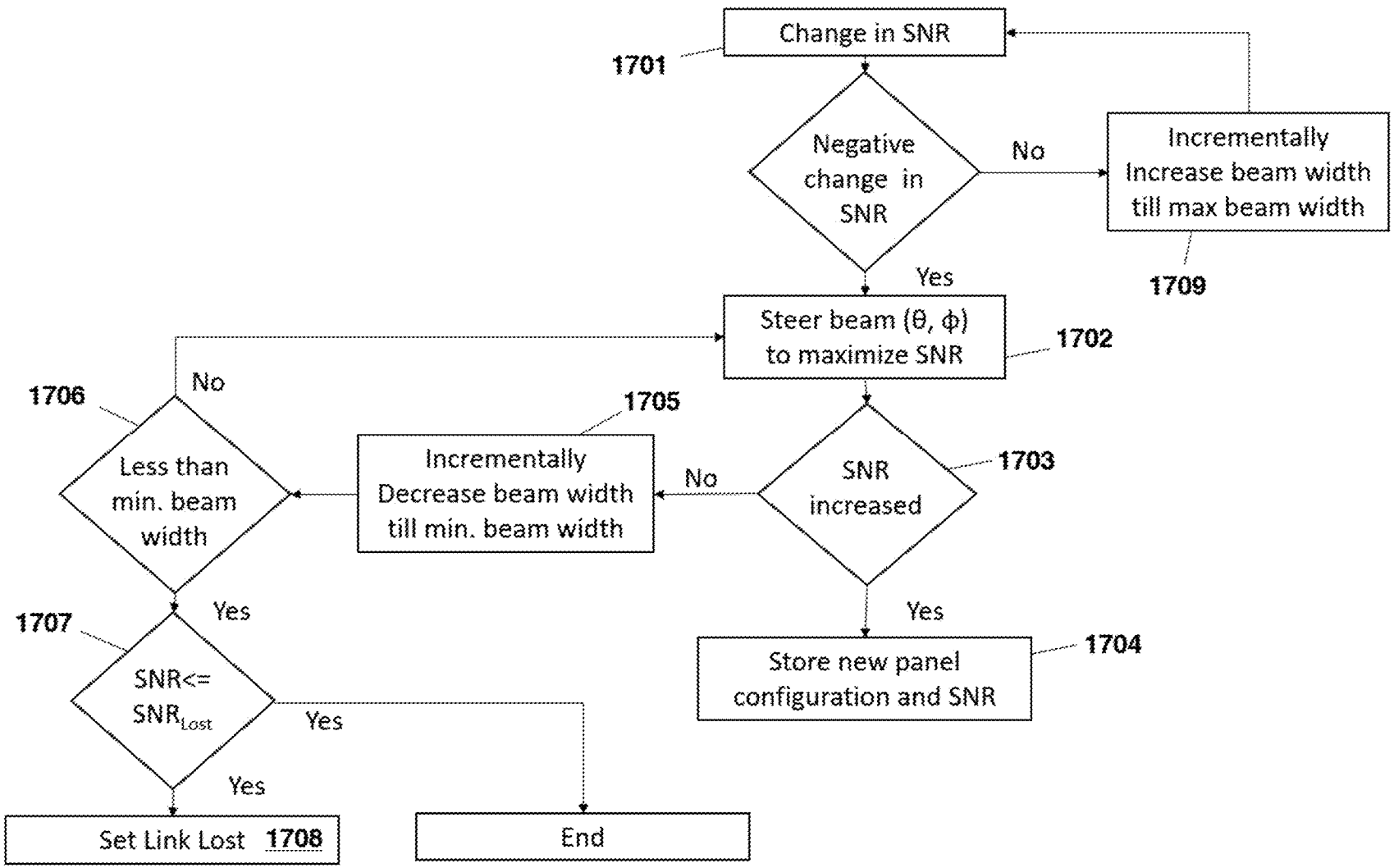
FIG. 17 is a flowchart illustrating the "Beam Control due to Change in SNR" algorithm used in the system shown in FIG. 10.
Figure 18:
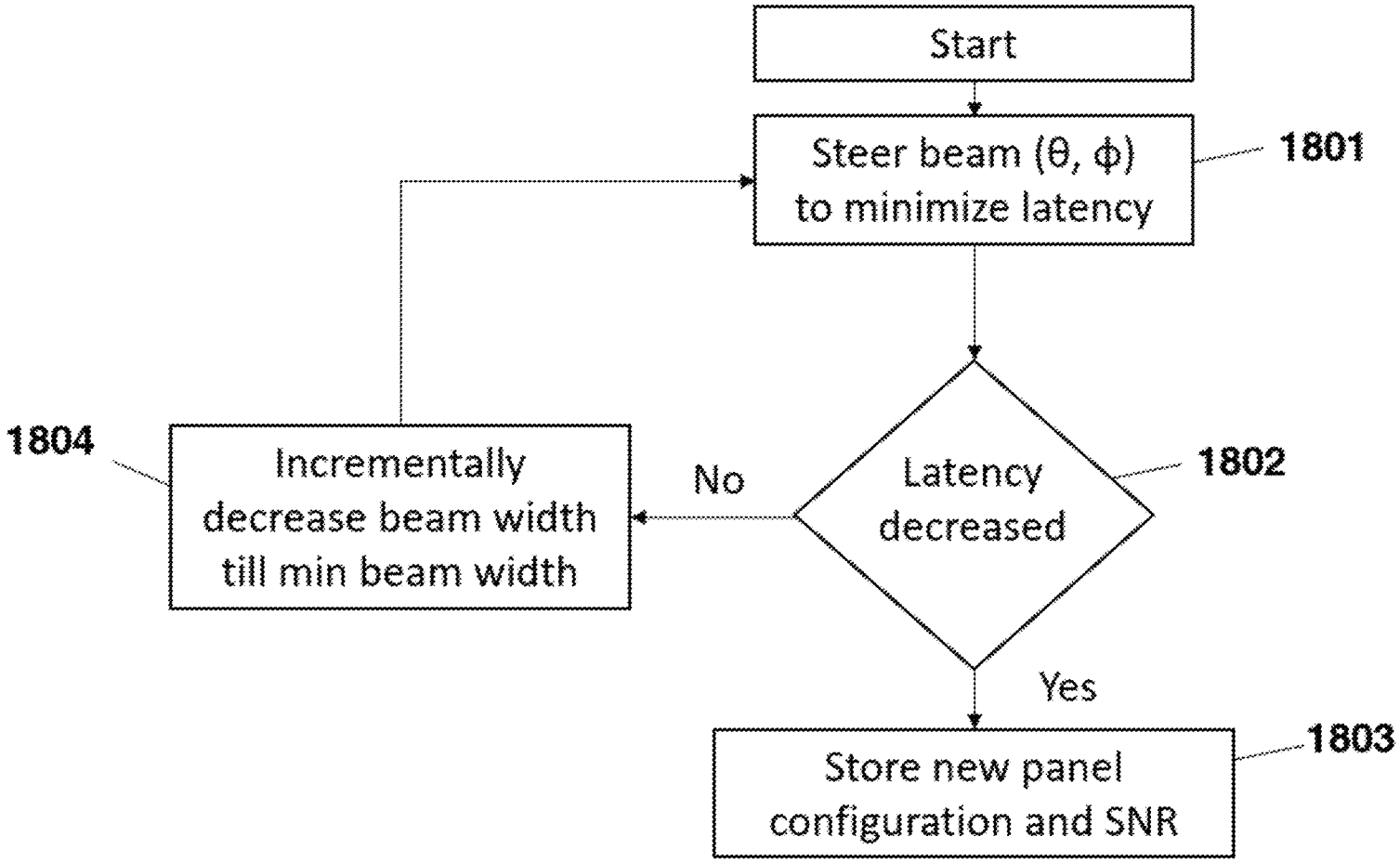
FIG. 18 is a flowchart illustrating the "Beam Control to Decrease the Latency algorithm" used in the system shown in FIG. 10.

FIG. 10 is a flowchart illustrating the control system of a reconfigurable antenna in accordance with an embodiment of the present invention. In process 1001, settings are loaded onto the processor/microcontroller/memory and processing device. These include settings for beamwidth, azimuthal and elevation angle resolutions, search resolutions in elevation (φ) and azimuthal (θ) directions, maximum directional beamwidth with the default set to omni-directional, minimum directional beamwidth, maximum latency allowable and important parameters for communication links (such as jitter, signal-to noise ratio (SNR), etc.) and their thresholds for jamming/lost links denoted as Link Parameters. After the settings are loaded, in process 1002, a handshake is initiated between the current node and other nodes in an N-way communication link. (A 2-way communication link is established between the current node and another node, and alternatively a relay link among more than 2 nodes can also be established.) After the handshake, the antenna system is configured to start communicating while, for example, SNR and latency are constantly being measured and stored. Checks are performed when there is change in SNR or Latency. If the SNR link parameter exceeds the threshold set for jamming signal, the "Anti-jam Protection" mode is activated as shown in FIG. 14. In process 1003, when this routine finishes, panel configurations are loaded and communication starts again. In process 1004, SNR link parameters and latency are measured and stored. In process 1005, if the change in SNR link parameter is less than the jamming threshold then in process 1006, the "Beam Control due to change in SNR routine" is activated as shown in FIG. 17. If at decision point 1007, this routine finishes with a link lost set, handshake routine is performed again. If at decision point 1007, the routine finishes without the link lost set, communication is resumed with the new panel configurations. If the latency increases 1008 then in process 1009 the "Beam Control to minimize latency routine", as shown in FIG. 18, is activated and at the end of this routine the communication is resumed with the new panel configurations. If interference or jamming is detected 1010, then, in process 1011, anti-jam procedures are implemented.

Figure 11:
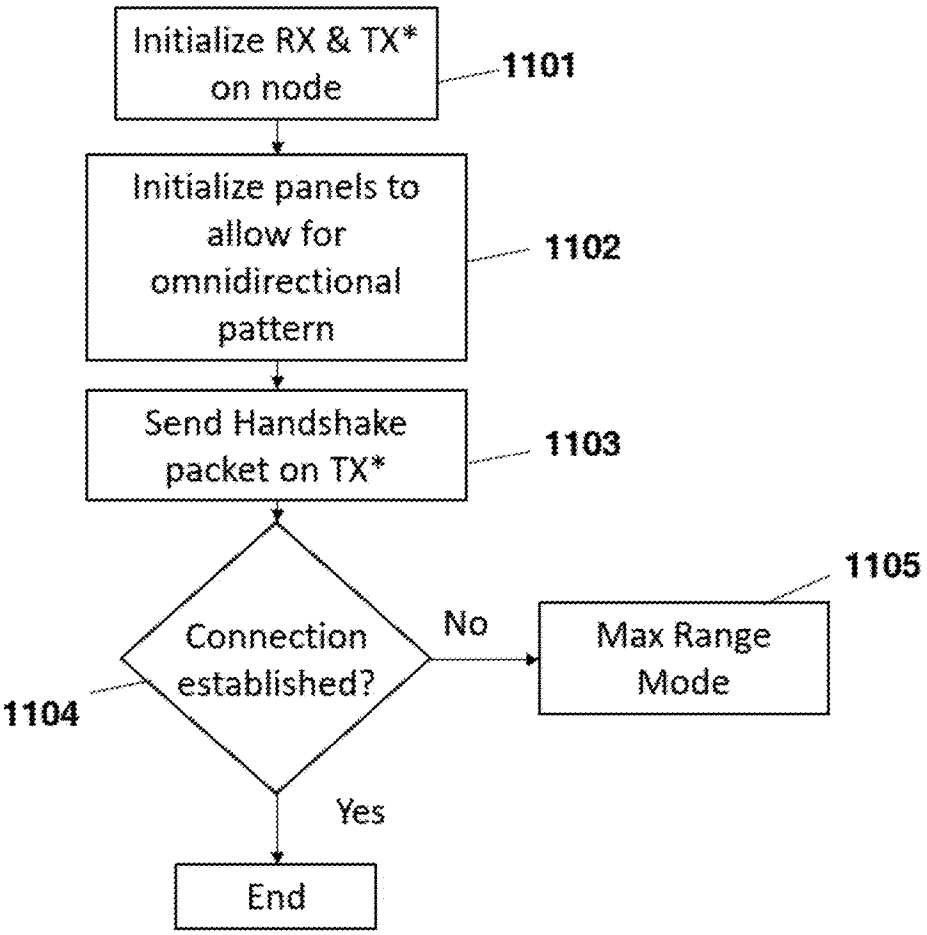
FIG. 11 is a flowchart illustrating the handshake algorithm within the system block diagram of FIG. 10, in accordance with an embodiment of the present invention.
Figure 12:
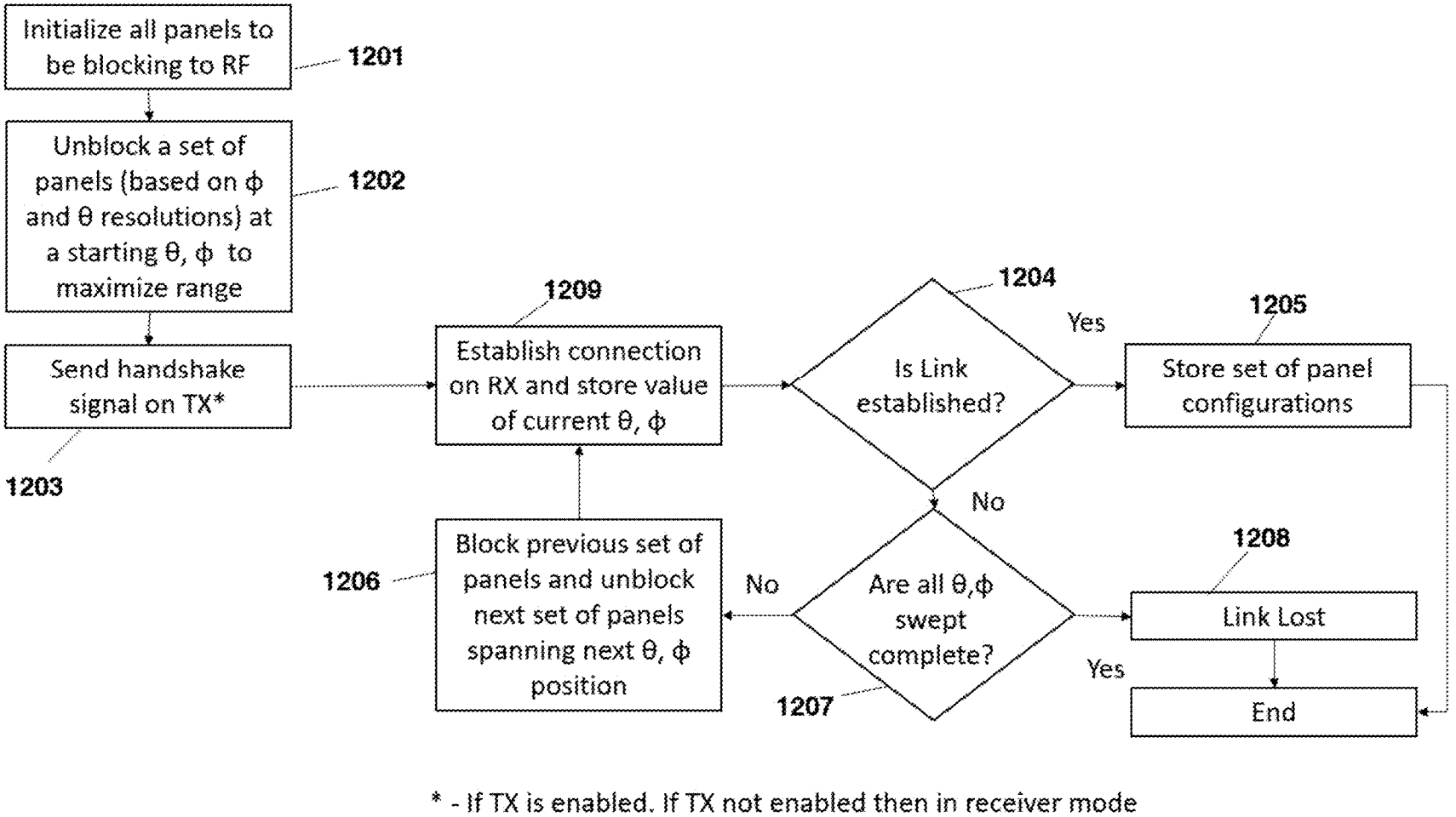
FIG. 12 is a flowchart illustrating the "Max Range Mode" used within the handshake algorithm in FIG. 11.

FIG. 11 is a flowchart illustrating the handshake algorithm within the system block diagram of FIG. 10, in accordance with an embodiment of the present invention. In process 1101, RX and TX are initialized (if TX is not enabled then only the RX is enabled). In process 1102, the panels are first initialized for an omnidirectional pattern. In process 1103, a handshake packet is sent on TX. At decision point 1104, there is a test whether a connection has been established. If the connection is not established, it could mean that the node is further out in range than the omnidirectional pattern. In process 1105, the "Max Range Mode", as shown in FIG. 12, is activated to find a link and complete the handshake or the link is lost. If the connection is established, then processing is complete.

Figure 13:
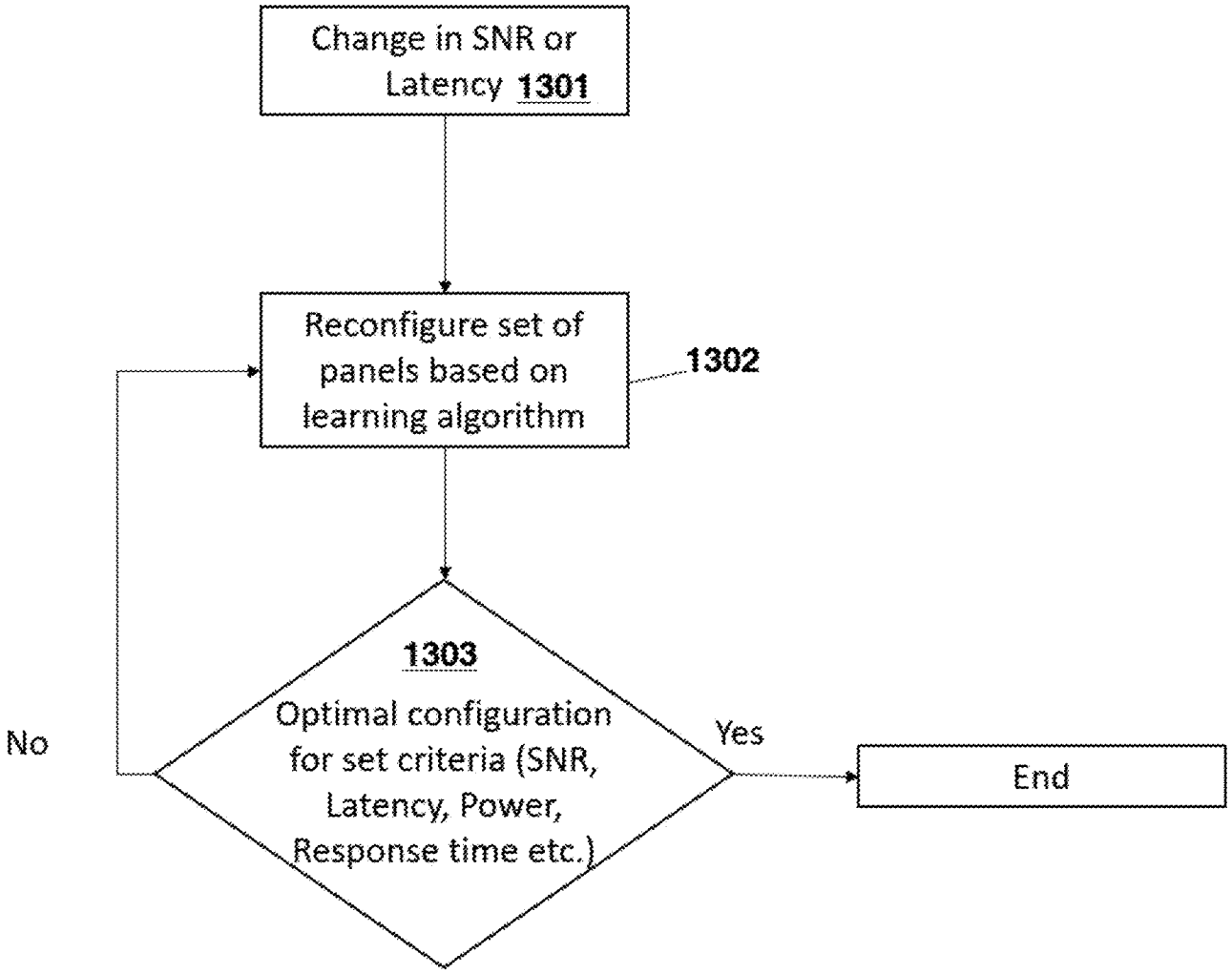
FIG. 13 is a flowchart illustrating the "Beam Control algorithm" for the antenna system which uses machine learning, in accordance with an embodiment of the present invention.

FIG. 12 is a flowchart illustrating the "Max Range Mode" used within the handshake algorithm in FIG. 11. In process 1201, all the panels are set to be blocking. A set of panels (corresponding to the φ and θ resolution settings) are unblocked, in process 1202, at an initial θ and φ position. Depending on whether TX is enabled, a handshake signal is sent out, in process 1203, to establish connection on the receiver. At decision point 1204, there is a test to determine if the link is established. If the link is established, then, in process 1205, the values of azimuth (θ) or elevation (φ), are stored. If no connection is established at the current azimuth (θ) or elevation (φ) then, there is a test at decision point 1207, to determine whether the sweep of θ and φ positions is complete. If not , then in process 1206, the current set of panels are blocked before unblocking the next set of φ, θ panels. The new set of φ, θ panels are stored in process 1209. This procedure is repeated acting as a sweep to find the node to connect to in all possible directions. If at decision point 1207, it is determined that the sweep is complete, and the link has not been established, then in process 1208, the link is deemed lost. Otherwise the set of panel configurations are stored, in process 1205, and the handshake is completed for this node. FIG. 13 is a flowchart illustrating the "Beam Control algorithm" for the antenna system which uses machine learning, in accordance with an embodiment of the present invention. In process 1301, this function is activated when there is a change in the SNR or latency. In process 1302, the current set of panel configurations are used and reconfigured based on a machine learning algorithm such that the set of criteria is optimized. The criteria to be optimized can be selected from SNR, latency, response time, power etc. or any combination of Link Parameters. In decision point 1303, there is a test for optimization, and if optimization has not been achieved, reconfiguration is repeated in process 1302.

FIG. 14 is a flowchart illustrating the "Anti-Jam Protection" algorithm used in the system block diagram of FIG. 10. In step 1401, values of SNR prior to jamming are loaded along with timeout settings. In the case of jamming, in process 1402, all panels that are not used in communications are blocked. In decision point 1403, if the SNR signal drops below the interference threshold then, in process 1404, the software packets are evaluated to be safe until, in decision point 1405, a certain time has elapsed as described by the timeout value. The node is then determined to be no longer jammed and can return to communication mode. If, however, in decision point 1403, it is determined that the SNR value does not drop below the interference threshold, then in process 1406, each individual communication link is blocked off one at a time to see if a link is compromised without compromising the other links. The link is blocked again till a certain time has elapsed through the timeout setting.

Figure 15:
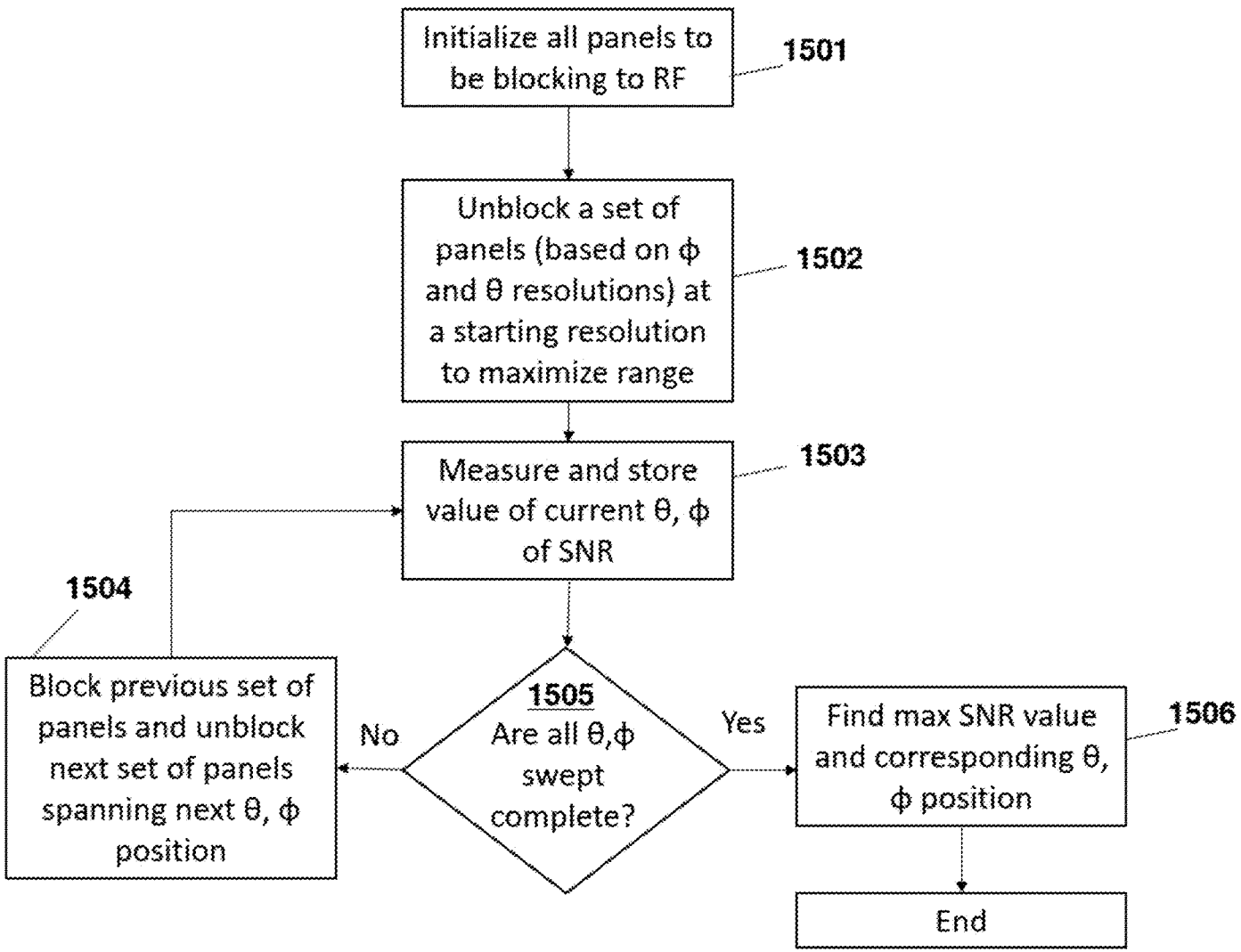
FIG. 15 is a flowchart illustrating the implementation a "Direction Finding" algorithm, in accordance with an embodiment of the present invention.

FIG. 15 is a flowchart illustrating the implementation a "Direction Finding" algorithm, in accordance with an embodiment of the present invention. In process 1501, all the panels are set to be blocking before in process 1502 unblocking a set of panels (corresponding to the φ and θ resolution settings) at an initial θ and φ position. In process 1503, SNR values are measured and stored before, in process 1504, blocking the current panels and moving onto the next set of panels. This process is continued until at decision point 1505, it has been determined that a complete sweep of panels has been completed. Once all panels and directions are swept, in process 1506, the table of SNR values is analyzed to find the maximum SNR giving the corresponding azimuthal and elevation direction of the signal.

Figure 16:
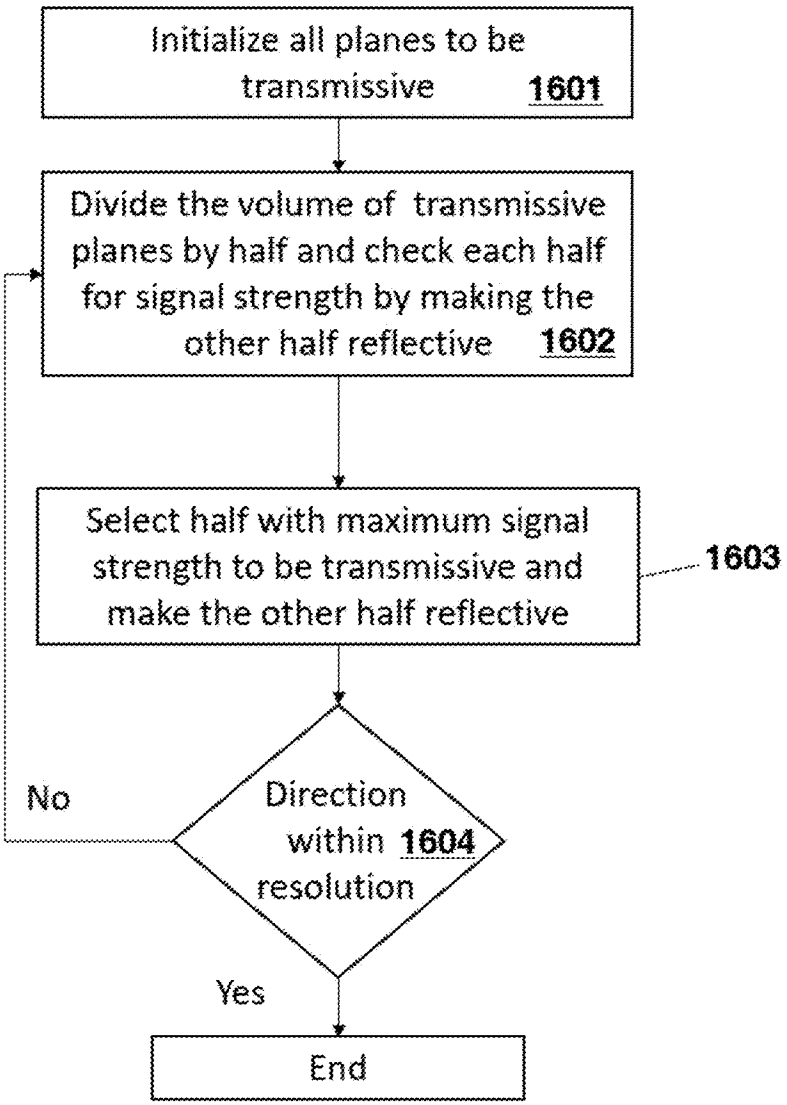
FIG. 16 is a flowchart illustrating a second embodiment of the "Direction Finding" algorithm, in accordance with an embodiment of the present invention.

FIG. 16 is a flowchart illustrating a second embodiment of the "Direction Finding" algorithm, in accordance with an embodiment of the present invention. In process 1601, all panels are initialized to be transmissive. In process 1602, the volume of the transmissive planes is divided into two and the signal strength in each half is measured and recorded. In process 1603, the half with the highest signal strength is then further divided into two halves and both halves are checked for maximum signal strength reception. This division continues to decision point 1604, wherein it is determined that the direction is within the resolution specified. This algorithm can also incorporate details of the previous algorithm specified in FIG. 15.

FIG. 17 is a flowchart illustrating the "Beam Control due to Change in SNR" algorithm used in the system shown in FIG. 10. This routine is run when there is a change in SNR. In decision point 1701, the change in SNR is evaluated. If the change is positive, then in process 1709, the beamwidth is incrementally increased till the maximum beamwidth is reached. If the change is negative, then in process 1702, the beam needs to be steered in φ and θ direction to locate the node. After the beamsteering, in decision point 1703, the change in SNR is evaluated; if the change in SNR is positive, then the new panel configuration is stored in process 1704. If the SNR did not increase then in process 1705, the beamwidth is incrementally decreased until at decision point 1706 it is determined that the minimum beamwidth is reached. If the minimum beamwidth is reached and if at decision point 1707 it is determined that the SNR is below the SNR threshold for a lost device, then the link lost flag is set in process 1708.

FIG. 18 is a flowchart illustrating the "Beam Control to Decrease the Latency algorithm" used in the system shown in FIG. 10. In process 1801, the beam is steered in φ and θ directions to minimize latency. At decision point 1802, it is determined whether the latency has decreased. If the latency has decreased, the beam is steered in φ and θ direction and in process 1803 the configuration providing the lowest latency is stored. If the latency has not decreased from the previous value, then in process 1804 the beamwidth is incrementally decreased until minimum beamwidth is reached.

Figure 19:
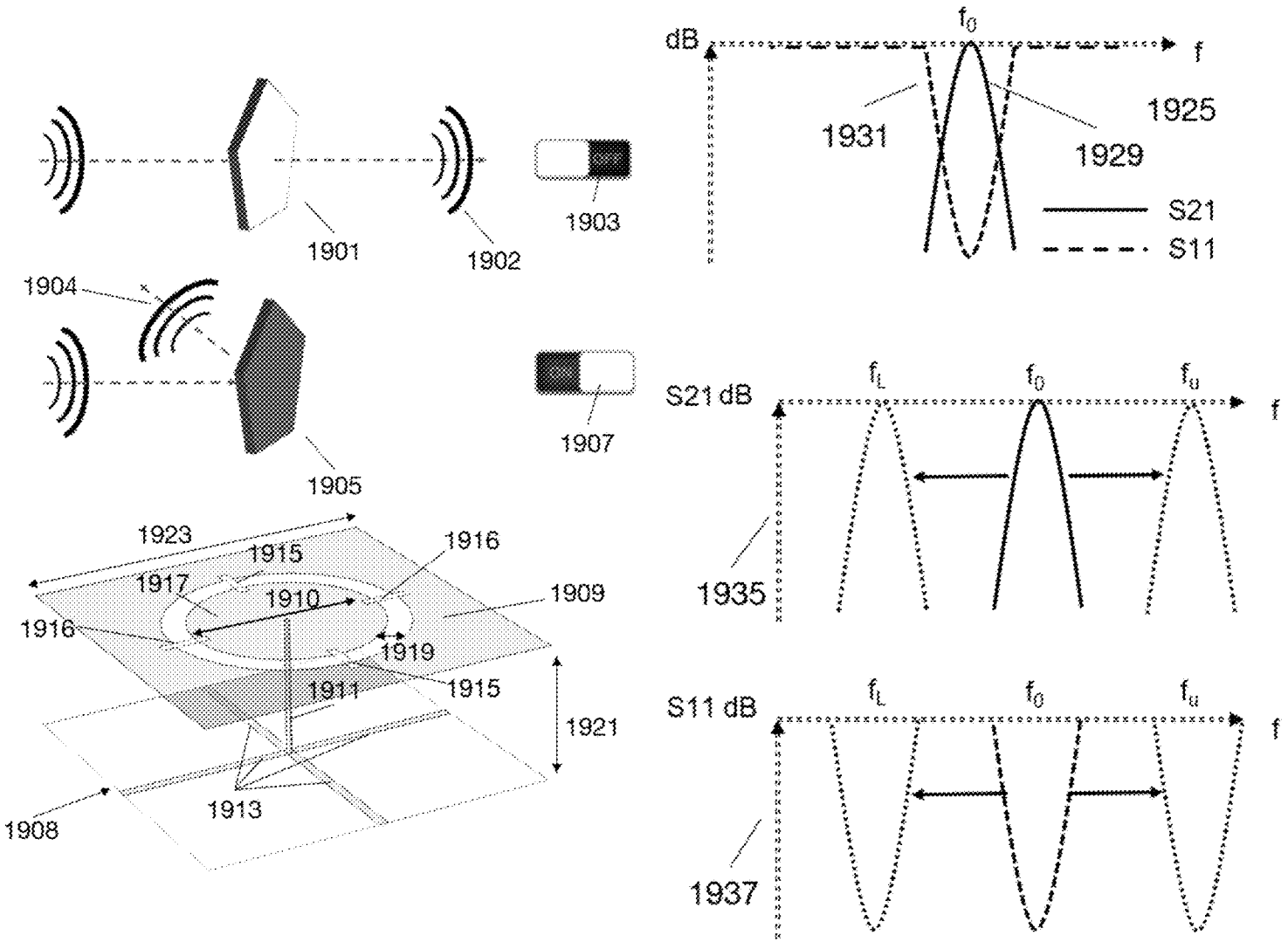
FIG. 19 is a diagram of the general operation of an active metamaterial with an example design of a 2D active frequency selective surface element controlled by electronic elements.

FIG. 19 is a diagram of the general operation of an active metamaterial with an example design of a 2D active frequency selective surface element controlled by electronic elements. In this figure an active metamaterial 1901 experiences an electromagnetic wave 1902 that has been transmitted through the material when the material is in off state 1903. When the material is in an on state 1907 it is reflective and produces reflected wave 1904. This behavior occurs at a specific resonant frequency for which the metamaterial is tuned. Alternatively, the material can be designed to be reflective, when off, and transmissive when on. In this case, the active metamaterial is made of repeated elements with switchable elements that can be controlled through electronic means. Item 1908 is an example of a basic building block for such an active metamaterial, that can change its resonant frequency. The block made of ring element apertures in the complimentary form with the conductive media 1909, 1917, 1913 and 1911 being shown as shaded. The different tunable dimensions such as radius of ring 1910, width of ring 1919, period 1923, height of the substrate 1921 separating the bottom grid and top periodic structure etc. operate to determine desired filter characteristics. Below the ring element aperture layer, is another grid layer 1913. The two layers are connected by a via or metal post 1911. Scattering parameters S21 measure the transmission of the wave through the metamaterial with Port 2 denoted as the wave's exit port through the metamaterial and Port 1 being the port on which the electromagnetic wave impinges. Graph 1925 plots attenuation in dB of the scattering parameters S21, S11 as a function of frequency. Plot 1929 represents the S21 transmission scattering parameter while plot 1931 represents the reflection S11 scattering parameter (measured at Port 1 generated from Port 1). The plots show that the metamaterial is transparent at the tuned resonant frequency $f_0$ with close to 0 dB attenuation and will reflect any out of band frequency that is outside of the region $f_0$. The addition of PIN, PN, and varactor diodes, or combinations of these elements, can be placed across the aperture gap 1915, 1916 such that these elements are effectively connected in a parallel circuit whereby the bottom layer grid layer is grounded, and the top layer has a voltage applied to it. The PN, PIN or varactor diodes are distributed around the ring (e.g. 1916/1915—PIN/varactor diodes) and with an applied voltage can be forward or reverse biased whereby, changing the diodes capacitance and subsequently the metamaterial's resonant frequency of transmission (S21) 1935 and reflection (S11) 1937 to either a lower $f_L$ or higher frequency $f_U$ than the resonant frequency $f_0$. This forms a basic building block of the active metamaterial subpanel or panel. Subpanels have an individually addressable voltage grid network that forms a separate part of a larger voltage grid network of the entire panel.

Figure 20:
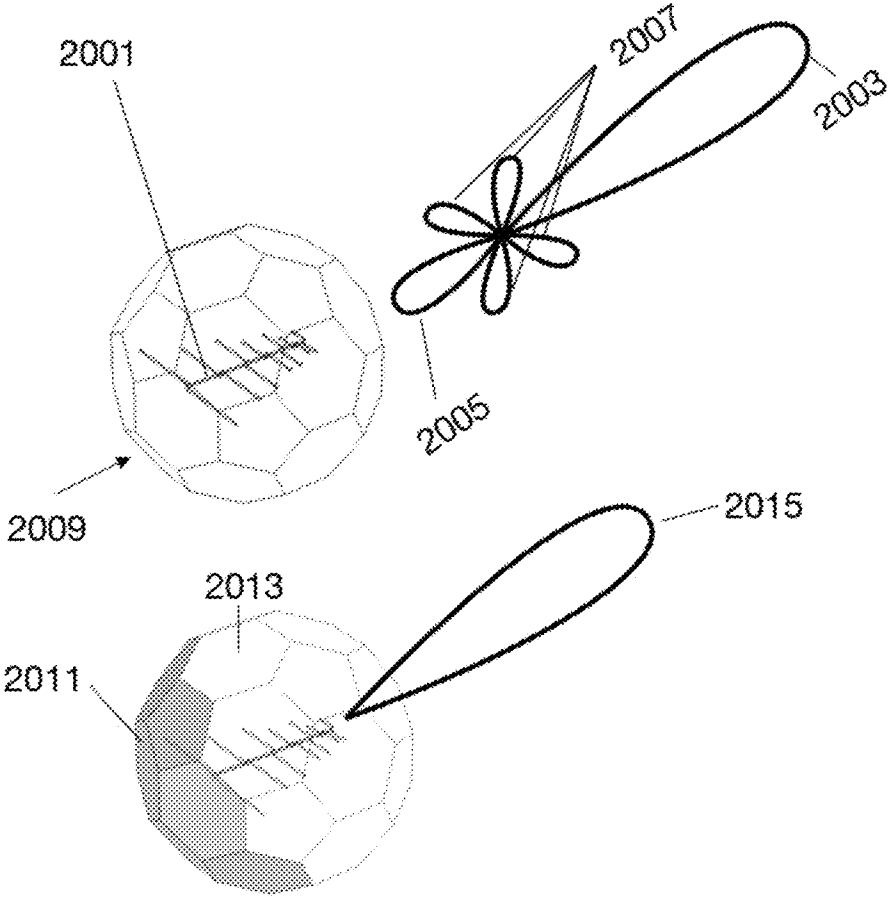
FIG. 20 is an example of controlling the metamaterial panels to change or suppress sidelobes, backlobes and the main lobe from a directional antenna in accordance with an embodiment of the present invention.

FIG. 20 illustrates a method of controlling the metamaterial panels to change or suppress sidelobes, backlobes and the main lobe from a directional antenna in accordance with an embodiment of the present invention. The metamaterial panels can change or suppress sidelobes 2007, backlobes 2005 and even modify the main lobe 2003 from a directional antenna 2001 to obtain a desired transmission or reception pattern, in accordance with an embodiment of the present invention. In the system 2009, the case with the metamaterial enclosure panels is set to be transparent (indicated by lack of shading) to the antenna radiated frequency and having the same radiation pattern with main and side lobes, as without the enclosure. In the system 2013, the same antenna system with the metamaterial enclosure has activated panels 2011 (indicated by shading) that are used to suppression the side lobes resulting only in main lobe 2015.

Figure 21:
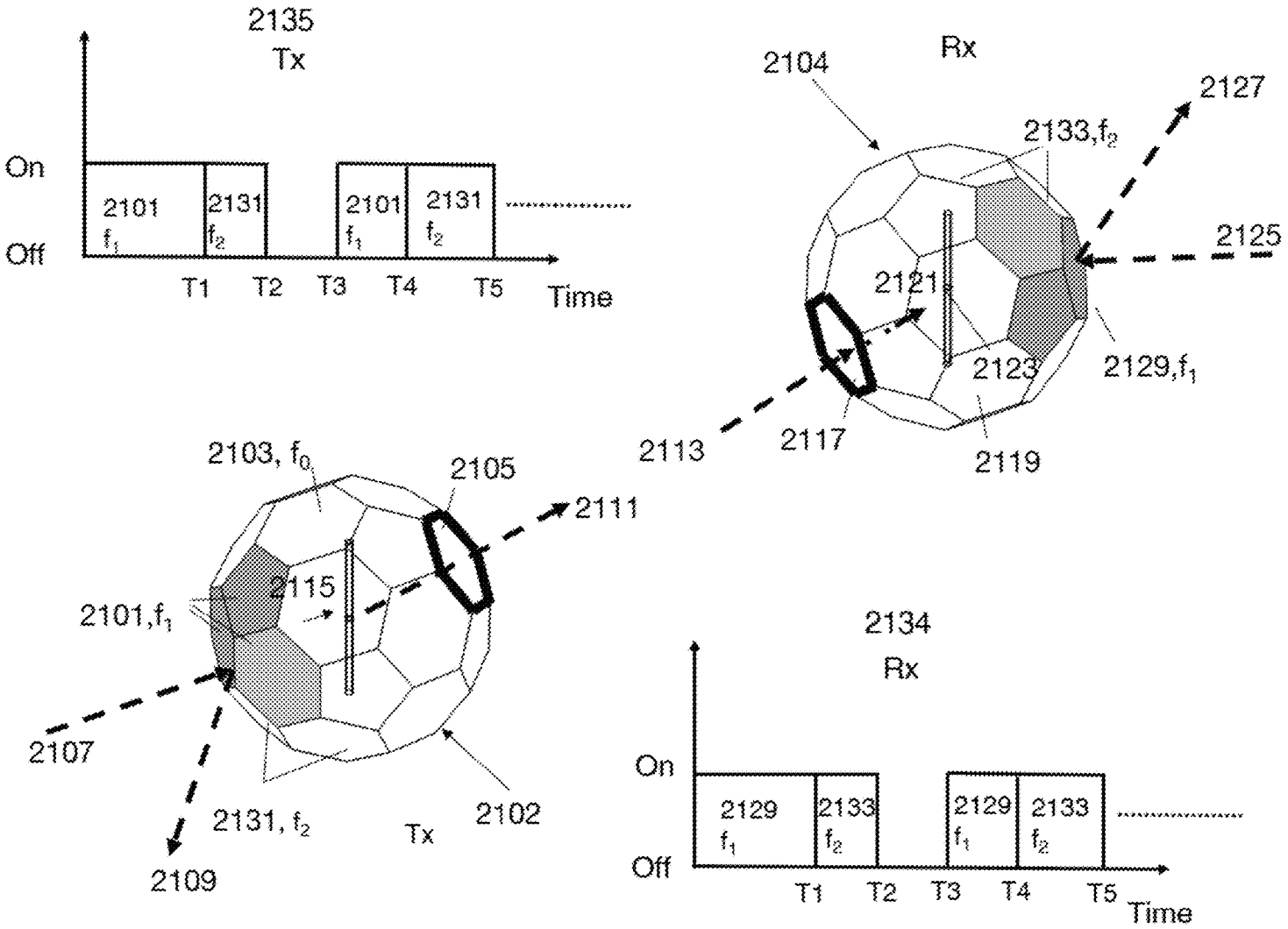
FIG. 21 is an example combining several embodiments that demonstrates secure wireless communication links by creating a point to point link between 2 antennas (in this case) that can protect against outside jamming attacks and control the transmission and reception side lobes, preventing the transmission from being detected by eavesdroppers in accordance with an embodiment of the present invention.

FIG. 21 is an example, combining several embodiments, that demonstrates secure wireless communication links by creating a point to point link between 2 antennas (in this case) that can protect against outside jamming attacks and control the transmission and reception side lobes, preventing the transmission from being detected by eavesdroppers in accordance with an embodiment of the present invention. A similar point to point link can also be used to maximize wireless power transmission and reception for the purposes of powering up devices remotely. The individual metamaterial panels that make up the enclosure and their individual properties can be controlled in software. Modulating these properties in time allows for another dimension of security in transmission. The enclosure 2102 around the transmitter antenna 2115 is made of metamaterial panels that can be independently controlled along with control of at least one of their properties. The transmitter antenna transmits at a frequency $f_0$ and the electromagnetic waves reflect off the panels 2101 (indicated by shading) on the inside of the enclosure and concentrate the electromagnetic wave energy in the direction 2111 towards the receiver antenna 2104 passing through the transmissive metamaterial panel 2105. The panels 2101 have been set to reflect simply by changing the resonant frequency of the panel to $f_1$ from $f_0$. This configuration also reflects a jamming signal 2107 in the direction 2109, impinged from the outside of the enclosure to disrupt the TX antenna. The transmitted signal enters the receiver antenna enclosure 2104 through the metamaterial panel 2117 that is also transparent to the electromagnetic wave at $f_0$. The signal can be power limited along the internal path 2121 and is received by the receiving antenna 2123. The receiving antenna 2123 is also enclosed by metamaterial panels 2119 that can be individually controlled to modify at least one of their properties. In this example, to boost the reception panel, the metamaterial panels 2129 are made reflective (by changing their resonant frequency from $f_0$ to $f_1$), as indicated by shading, to increase the reception pattern in the direction 2113. The receiving antenna can also protect against jamming attacks 2125 from the outside of the enclosure reflecting it away in direction 2127 from the receiving antenna. By modulating the control of the panels of the transmitter in time and applying the same modulation to the receiver, a communication link with additional dimensions of security can be established. The transmitter modulation pattern 2135 is a plot of the sequence of panels turned "on" in time and the duration over which they are turned on. For the transmitter, the panels 2101 are turned on, set to frequency $f_1$ and are held on until time $T_1$. Next the panels 2131 are turned on, set to $f_2$ and held on until time $T_2$. Then all panels are held off until time $T_3$, followed by 2101 at $f_1$ held until $T_4$ and then 2131 at $f_2$ until $T_5$ and so on. By changing the panels from 2101 to 2131 on the Tx side, the direction of the transmission correspondingly changes, so as to add a spatial direction dimension of security to the link. Only a receiver with a modulation pattern 2134 that matches that of the transmitter can subsequently receive the transmitted signal by turning on panels 2129 tuned at $f_1$ held until $T_1$, panels 2133 at $f_2$ until $T_2$ and so on, to match the modulation of the transmitter.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A reconfigurable antenna system comprising:

an antenna array;

a set of metamaterial panels configured to surround the antenna array;

a control unit, coupled to each of the metamaterial panels, for selectively addressing each of the metamaterial panels to control separately at least one property of each of the metamaterial panels;

a receiver coupled to the antenna array and to the control unit;

wherein the control unit is configured to monitor signal reception by the antenna array via the receiver and to establish a first set of configurations of the metamaterial panels to produce a pattern of reception according to a first set of prespecified criteria that include a set of azimuthal and elevational ranges characterizing the configurations.

2. A reconfigurable antenna system according to claim 1, further comprising:

a transmitter coupled to the antenna array and to the control unit;

wherein the control unit is further configured to establish a second set of configurations to produce a radiation pattern according to a second set of prespecified criteria.

3. A reconfigurable antenna system according to claim 1, wherein the first set of prespecified criteria establishes a reception pattern, having a beam shape, to improve reception of the signal from an external antenna array of interest.

4. A reconfigurable antenna system according to claim 2, wherein the second set of prespecified criteria establishes a radiation pattern, having a beam shape, to improve transmission of the signal to an external antenna array of interest.

5. A reconfigurable antenna system according to claim 1, wherein, in the presence of a jamming signal attack, the control unit is configured to modify the first set of prespecified criteria to establish a pattern of reflection or absorption using at least one of the metamaterial panels, in the set of metamaterial panels, to attenuate the jamming signal.

6. A reconfigurable antenna system according to claim 1, wherein the control unit is configured to modify the first set of prespecified criteria to establish a lobe of reception that is swept over first and second angular spans of azimuthal and elevational coordinates respectively.

7. A reconfigurable antenna system of claim 6, wherein the control unit is configured to correlate output of the receiver as a function of angular orientation of the lobe of reception and to associate, with a direction of an incoming signal, the angular orientation of the lobe at which the receiver output is at a maximum.

8. A reconfigurable antenna system according to claim 1, wherein the control unit is configured to modify the first set of prespecified criteria to establish a pattern of reception that minimizes latency, of a received signal, attributable to multipath.

9. An antenna system according to claim 1, wherein the set of metamaterial panels is configured to become reflective in the presence of electromagnetic wave energy that exceeds a threshold level.

10. A reconfigurable antenna system according to claim 1, wherein the control unit is configured to independently control side lobes of reception.

11. A reconfigurable antenna system according to claim 2, wherein the control unit is configured to independently control side lobes of reception and transmission.

12. A reconfigurable antenna system according to claim 2, wherein the control unit is configured to modulate, over time, a set of properties of the metamaterial panels to establish, for purposes of security, a modulated pattern of transmission that can be received only via a correspondingly configured antenna system.

13. A reconfigurable antenna system according to claim 1, wherein the set of metamaterial panels is configured to enclose the antenna array.

14. A reconfigurable antenna system according to claim 13, wherein the set of metamaterial panels is configured to conform to a shape of the antenna array and associated electronics.

15. A reconfigurable antenna system according to claim 2, wherein the set of metamaterial panels is configured to enclose the antenna array and associated electronics.

16. A reconfigurable antenna system according to claim 15, wherein the set of metamaterial panels is configured to conform to a shape of the antenna array and associated electronics.

17. A reconfigurable antenna system according to claim 1, wherein the at least one property is selected from the group consisting of transmissivity, reflectivity, absorption, phase, polarization, bandwidth, angle sensitivity, and resonant frequency.

18. A reconfigurable antenna system according to claim 2, wherein the at least one property is selected from the group consisting of transmissivity, reflectivity, absorption, phase, polarization, bandwidth, angle sensitivity, and resonant frequency.

19. A reconfigurable antenna system according to claim 1, wherein the first set of prespecified criteria includes a beam shape configured to improve reception of wireless power from an external antenna array of interest.

20. A reconfigurable antenna system according to claim 2, wherein the second set of prespecified criteria includes a beam shape configured to improve wireless power transmission to an external antenna array of interest.

* * * * *